US010874271B2

(12) United States Patent
Kastensson et al.

(10) Patent No.: US 10,874,271 B2
(45) Date of Patent: Dec. 29, 2020

(54) SIDE BRUSH AND ROBOTIC CLEANER

(71) Applicant: Aktiebolaget Electrolux, Stockholm (SE)

(72) Inventors: Daniel Kastensson, Stockholm (SE); Andreas Klintemyr, Stockholm (SE)

(73) Assignee: AKTIEBOLAGET ELECTROLUX, Stockholm (SE)

( * ) Notice: Subject to any disclaimer, the term of this patent is extended or adjusted under 35 U.S.C. 154(b) by 229 days.

(21) Appl. No.: 15/534,591

(22) PCT Filed: Dec. 12, 2014

(86) PCT No.: PCT/EP2014/077549
§ 371 (c)(1),
(2) Date: Jun. 9, 2017

(87) PCT Pub. No.: WO2016/091320
PCT Pub. Date: Jun. 16, 2016

(65) Prior Publication Data

US 2017/0354303 A1 Dec. 14, 2017

(51) Int. Cl.
*A47L 9/04* (2006.01)
*A46B 13/00* (2006.01)
(Continued)

(52) U.S. Cl.
CPC ..... *A47L 9/0488* (2013.01); *A46B 9/02* (2013.01); *A46B 9/026* (2013.01); *A46B 13/008* (2013.01);
(Continued)

(58) Field of Classification Search
CPC ..... A46B 9/02; A46B 9/025; A46B 9/026; A46B 9/028
See application file for complete search history.

(56) References Cited

U.S. PATENT DOCUMENTS 1,286,321 A 12/1918 Hoover
1,401,007 A 12/1921 Staples
(Continued)

FOREIGN PATENT DOCUMENTS

CA 2154758 6/1995
CN 1116818 2/1996
(Continued)

OTHER PUBLICATIONS

Notice of Allowance for U.S. Appl. No. 15/102,295, dated Sep. 24, 2018, 9 pages.
(Continued)

*Primary Examiner* — Andrew A Horton
(74) *Attorney, Agent, or Firm* — RatnerPrestia

(57) ABSTRACT

A side brush for a robotic cleaner. The side brush is rotatable about a rotation axis in a rotational direction and has a brush body and numerous linear bristles including a first bristle having a base end at the brush body and an opposite distal end. An imaginary line extends perpendicularly to the rotation axis. The first bristle extends in a bristle direction outwardly from the brush body. Seen in a top view, the bristle direction extends at a first angle to the imaginary line with the distal end pointing rearwardly in relation to the rotational direction. Seen in a side view, the bristle direction extends at a second acute angle to the rotation axis pointing away from the brush body. A robotic cleaner having such a side brush is also disclosed herein.

13 Claims, 5 Drawing Sheets

(51) Int. Cl.

| | |
|---|---|
| ***A47L 11/40*** | (2006.01) |
| ***A46B 9/02*** | (2006.01) |
| ***A47L 5/22*** | (2006.01) |
| ***A47L 9/00*** | (2006.01) |
| ***A47L 9/14*** | (2006.01) |
| ***A47L 9/28*** | (2006.01) |

(52) U.S. Cl.

CPC ..... *A47L 5/22* (2013.01); *A47L 9/009* (2013.01); *A47L 9/0411* (2013.01); *A47L 9/0427* (2013.01); *A47L 9/0472* (2013.01); *A47L 9/0477* (2013.01); *A47L 9/149* (2013.01); *A47L 9/2805* (2013.01); *A47L 9/2852* (2013.01); *A47L 9/2884* (2013.01); *A47L 11/4038* (2013.01); *A46B 2200/3033* (2013.01); *A46B 2200/3066* (2013.01); *A47L 2201/00* (2013.01); *A47L 2201/04* (2013.01)

(56) References Cited

U.S. PATENT DOCUMENTS

| | | | | |
|---|---|---|---|---|
| 1,823,128 | A * | 9/1931 | Scott | A46B 9/026 15/167.1 |
| 3,010,129 | A | 11/1961 | Moore | |
| 3,233,274 | A | 2/1966 | Kroll | |
| 3,550,714 | A | 12/1970 | Bellinger | |
| 3,570,227 | A | 3/1971 | Bellinger | |
| 3,713,505 | A | 1/1973 | Muller | |
| 3,837,028 | A | 9/1974 | Bridge | |
| 4,028,765 | A | 6/1977 | Liebscher | |
| 4,036,147 | A | 7/1977 | Westling | |
| 4,114,711 | A | 9/1978 | Wilkins | |
| 4,119,900 | A | 10/1978 | Kremnitz | |
| 4,306,174 | A | 12/1981 | Mourier | |
| 4,306,329 | A | 12/1981 | Yokoi | |
| 4,369,543 | A | 1/1983 | Chen | |
| 4,502,173 | A | 3/1985 | Patzold | |
| 4,627,511 | A | 12/1986 | Yajima | |
| 4,647,209 | A | 3/1987 | Neukomm | |
| 4,800,978 | A | 1/1989 | Wasa | |
| 4,822,450 | A | 4/1989 | Davis | |
| 4,825,091 | A | 4/1989 | Breyer | |
| 4,836,905 | A | 6/1989 | Davis | |
| 4,838,990 | A | 6/1989 | Jucha | |
| 4,842,686 | A | 6/1989 | Davis | |
| 4,849,067 | A | 7/1989 | Jucha | |
| 4,854,000 | A | 8/1989 | Takimoto | |
| 4,864,511 | A | 9/1989 | Moy | |
| 4,872,938 | A | 10/1989 | Davis | |
| 4,878,003 | A | 10/1989 | Knepper | |
| 4,886,570 | A | 12/1989 | Davis | |
| 4,918,607 | A | 4/1990 | Wible | |
| 4,919,224 | A | 4/1990 | Shyu | |
| 4,922,559 | A | 5/1990 | Wall | |
| 4,959,192 | A | 9/1990 | Trundle | |
| 4,962,453 | A | 10/1990 | Pong | |
| 4,989,818 | A | 2/1991 | Trundle | |
| 5,001,635 | A | 3/1991 | Yasutomi | |
| 5,006,302 | A | 4/1991 | Trundle | |
| 5,023,444 | A | 6/1991 | Ohman | |
| 5,032,775 | A | 7/1991 | Mizuno | |
| 5,034,673 | A | 7/1991 | Shoji | |
| 5,042,861 | A | 8/1991 | Trundle | |
| 5,045,118 | A | 9/1991 | Mason | |
| 5,086,535 | A | 2/1992 | Grossmeyer | |
| 5,095,577 | A | 3/1992 | Jonas | |
| 5,107,946 | A | 4/1992 | Kamimura | |
| 5,155,683 | A | 10/1992 | Rahim | |
| 5,243,732 | A | 9/1993 | Koharagi | |
| 5,245,177 | A | 9/1993 | Schiller | |
| 5,276,933 | A | 1/1994 | Hennessey | |
| 5,279,672 | A | 1/1994 | Betker | |
| 5,293,955 | A | 3/1994 | Lee | |
| 5,307,273 | A | 4/1994 | Oh | |
| 5,309,592 | A | 5/1994 | Hiratsuka | |
| 5,341,540 | A | 8/1994 | Soupert | |
| 5,345,639 | A | 9/1994 | Tanoue | |
| 5,349,378 | A | 9/1994 | FereydounMaali | |
| 5,353,224 | A | 10/1994 | Lee | |
| 5,367,458 | A | 11/1994 | Roberts et al. | |
| 5,369,347 | A | 11/1994 | Yoo | |
| 5,377,106 | A | 12/1994 | Drunk | |
| 5,390,627 | A | 2/1995 | van der Berg | |
| 5,398,632 | A | 3/1995 | Goldbach | |
| 5,402,051 | A | 3/1995 | Fujiwara | |
| 5,440,216 | A | 8/1995 | Kim | |
| 5,444,965 | A | 8/1995 | Colens | |
| 5,446,356 | A | 8/1995 | Kim | |
| 5,454,129 | A | 10/1995 | Kell | |
| 5,518,552 | A | 5/1996 | Tanoue | |
| 5,534,762 | A | 7/1996 | Kim | |
| 5,548,511 | A | 8/1996 | Bancroft | |
| 5,560,077 | A | 10/1996 | Crotchett | |
| 5,568,589 | A | 10/1996 | Hwang | |
| 5,621,291 | A | 4/1997 | Lee | |
| 5,646,494 | A | 7/1997 | Han | |
| 5,666,689 | A | 9/1997 | Andersen | |
| 5,682,313 | A | 10/1997 | Edlund | |
| 5,682,640 | A | 11/1997 | Han | |
| 5,687,294 | A | 11/1997 | Jeong | |
| 5,698,957 | A | 12/1997 | Sowada | |
| 5,745,946 | A | 5/1998 | Thrasher | |
| 5,758,298 | A | 5/1998 | Guldner | |
| 5,778,554 | A | 7/1998 | Jones | |
| 5,781,960 | A | 7/1998 | Kilstrom | |
| 5,787,545 | A | 8/1998 | Colens | |
| 5,815,880 | A | 10/1998 | Nakanishi | |
| 5,825,981 | A | 10/1998 | Matsuda | |
| 5,841,259 | A | 11/1998 | Kim | |
| 5,852,984 | A | 12/1998 | Matsuyama | |
| 5,867,800 | A | 2/1999 | Leif | |
| 5,890,250 | A | 4/1999 | Lange | |
| 5,896,488 | A | 4/1999 | Jeong | |
| 5,903,124 | A | 5/1999 | YuichiKawakami | |
| 5,926,909 | A | 7/1999 | McGee | |
| 5,933,902 | A | 8/1999 | Frey | |
| 5,935,179 | A | 8/1999 | Kleiner | |
| 5,940,927 | A | 8/1999 | Haegermarck | |
| 5,942,869 | A | 8/1999 | Katou | |
| 5,947,051 | A | 9/1999 | Geiger | |
| 5,959,423 | A | 9/1999 | Nakanishi | |
| 5,959,424 | A | 9/1999 | Elkmann | |
| 5,966,765 | A | 10/1999 | Hamada | |
| RE36,391 | E | 11/1999 | vandenBerg | |
| 5,983,833 | A | 11/1999 | van der Lely | |
| 5,987,696 | A | 11/1999 | Wang | |
| 5,991,951 | A | 11/1999 | Kubo | |
| 5,995,884 | A | 11/1999 | Allen | |
| 5,997,670 | A | 12/1999 | Walter | |
| 5,999,865 | A | 12/1999 | Bloomquist et al. | |
| 6,012,470 | A | 1/2000 | Jones | |
| 6,024,107 | A | 2/2000 | Jones | |
| 6,064,926 | A | 5/2000 | Sarangapani | |
| 6,076,662 | A | 6/2000 | Bahten | |
| 6,082,377 | A | 7/2000 | Frey | |
| 6,124,694 | A | 9/2000 | Bancroft | |
| 6,142,252 | A | 11/2000 | Kinto | |
| 6,176,067 | B1 | 1/2001 | Bahten | |
| 6,213,136 | B1 | 4/2001 | Jones | |
| 6,226,830 | B1 | 5/2001 | Hendriks | |
| 6,230,360 | B1 | 5/2001 | Singleton | |
| 6,251,551 | B1 | 6/2001 | Kunze-Concewitz | |
| 6,255,793 | B1 | 7/2001 | Peless | |
| 6,263,989 | B1 | 7/2001 | Won | |
| 6,300,737 | B1 | 10/2001 | Bergvall | |
| 6,311,366 | B1 | 11/2001 | Sepke | |
| 6,327,741 | B1 | 12/2001 | Reed | |
| 6,339,735 | B1 | 1/2002 | Peless | |
| 6,358,325 | B1 | 3/2002 | Andreas | |
| 6,360,801 | B1 | 3/2002 | Walter | |
| 6,370,452 | B1 | 4/2002 | Pfister | |
| 6,370,453 | B2 | 4/2002 | Sommer | |
| 6,381,801 | B1 | 5/2002 | Clemons, Sr. | |

(56) References Cited

U.S. PATENT DOCUMENTS

| | | | |
|---|---|---|---|
| 6,389,329 | B1 | 5/2002 | Colens |
| 6,413,149 | B1 | 7/2002 | Wada |
| 6,417,641 | B2 | 7/2002 | Peless |
| 6,431,296 | B1 | 8/2002 | Won |
| 6,438,456 | B1 | 8/2002 | Feddema |
| 6,443,509 | B1 | 9/2002 | Levin |
| 6,457,199 | B1 | 10/2002 | Frost |
| 6,457,206 | B1 | 10/2002 | Judson |
| 6,459,955 | B1 | 10/2002 | Bartsch |
| 6,465,982 | B1 | 10/2002 | Bergvall |
| 6,481,515 | B1 | 11/2002 | Kirkpatrick |
| 6,482,678 | B1 | 11/2002 | Frost |
| 6,493,612 | B1 | 12/2002 | Bisset |
| 6,493,613 | B2 | 12/2002 | Peless |
| 6,496,754 | B2 | 12/2002 | Song |
| 6,504,610 | B1 | 1/2003 | Bauer |
| 6,519,804 | B1 | 2/2003 | Vujik |
| 6,525,509 | B1 | 2/2003 | Petersson |
| D471,243 | S | 3/2003 | Cioffi |
| 6,532,404 | B2 | 3/2003 | Colens |
| 6,535,793 | B2 | 3/2003 | Allard |
| 6,571,415 | B2 | 6/2003 | Gerber |
| 6,580,246 | B2 | 6/2003 | Jacobs |
| 6,581,239 | B1 | 6/2003 | Dyson |
| 6,594,844 | B2 | 7/2003 | Jones |
| 6,597,143 | B2 | 7/2003 | Song |
| 6,601,265 | B1 | 8/2003 | Burlington |
| 6,605,156 | B1 | 8/2003 | Clark |
| 6,609,962 | B1 | 8/2003 | Wakabayashi |
| 6,611,120 | B2 | 8/2003 | Song |
| 6,611,318 | B2 | 8/2003 | LaPolice |
| 6,615,108 | B1 | 9/2003 | Peless |
| 6,615,885 | B1 | 9/2003 | Ohm |
| 6,633,150 | B1 | 10/2003 | Wallach |
| 6,637,446 | B2 | 10/2003 | Frost |
| 6,658,325 | B2 | 12/2003 | Zweig |
| 6,661,239 | B1 | 12/2003 | Ozick |
| 6,662,889 | B2 | 12/2003 | De Fazio |
| 6,667,592 | B2 | 12/2003 | Jacobs |
| 6,668,951 | B2 | 12/2003 | Won |
| 6,671,592 | B1 | 12/2003 | Bisset |
| 6,690,134 | B1 | 2/2004 | Jones |
| 6,726,823 | B1 | 4/2004 | Wang |
| 6,732,826 | B2 | 5/2004 | Song |
| 6,745,431 | B2 | 6/2004 | Dijksman |
| 6,748,297 | B2 | 6/2004 | Song |
| 6,769,004 | B2 | 7/2004 | Barrett |
| 6,774,596 | B1 | 8/2004 | Bisset |
| 6,775,871 | B1 | 8/2004 | Finch |
| 6,781,338 | B2 | 8/2004 | Jones |
| 6,809,490 | B2 | 10/2004 | Jones |
| 6,810,305 | B2 | 10/2004 | Kirkpatrick, Jr. |
| 6,820,801 | B2 | 11/2004 | Kaneko |
| 6,841,963 | B2 | 1/2005 | Song |
| 6,845,297 | B2 | 1/2005 | Allard |
| 6,850,024 | B2 | 2/2005 | Peless |
| 6,859,010 | B2 | 2/2005 | Jeon |
| 6,859,976 | B2 | 3/2005 | Plankenhorn |
| 6,860,206 | B1 | 3/2005 | Rudakevych |
| 6,868,307 | B2 | 3/2005 | Song |
| 6,869,633 | B2 | 3/2005 | Sus |
| 6,870,792 | B2 | 3/2005 | Chiappetta |
| 6,882,334 | B1 | 4/2005 | Meyer |
| 6,883,201 | B2 | 4/2005 | Jones |
| 6,885,912 | B2 | 4/2005 | Peless |
| 6,901,624 | B2 | 6/2005 | Mori |
| 6,925,679 | B2 | 8/2005 | Wallach |
| D510,066 | S | 9/2005 | Hickey |
| 6,938,298 | B2 | 9/2005 | Aasen |
| 6,939,208 | B2 | 9/2005 | Kamimura |
| 6,940,291 | B1 | 9/2005 | Ozick |
| 6,941,199 | B1 | 9/2005 | Bottomley |
| 6,942,548 | B2 | 9/2005 | Wada |
| 6,956,348 | B2 | 10/2005 | Landry |
| 6,957,712 | B2 | 10/2005 | Song |
| 6,964,312 | B2 | 11/2005 | Maggio |
| 6,965,209 | B2 | 11/2005 | Jones |
| 6,967,275 | B2 | 11/2005 | Ozick |
| 6,971,140 | B2 | 12/2005 | Kim |
| 6,971,141 | B1 | 12/2005 | Tak |
| 6,984,952 | B2 | 1/2006 | Peless |
| 7,000,623 | B2 | 2/2006 | Welsh |
| 7,004,269 | B2 | 2/2006 | Song |
| 7,013,200 | B2 | 3/2006 | Wakui |
| 7,013,527 | B2 | 3/2006 | Thomas, Sr. |
| 7,015,831 | B2 | 3/2006 | Karlsson |
| 7,024,278 | B2 | 4/2006 | Chiappetta |
| 7,031,805 | B2 | 4/2006 | Lee |
| 7,040,968 | B2 | 5/2006 | Kamimura |
| 7,042,342 | B2 | 5/2006 | Luo |
| 7,043,794 | B2 | 5/2006 | Conner |
| 7,050,926 | B2 | 5/2006 | Theurer et al. |
| 7,053,578 | B2 | 5/2006 | Diehl et al. |
| 7,053,580 | B2 | 5/2006 | Aldred |
| 7,054,716 | B2 | 5/2006 | McKee |
| 7,059,012 | B2 | 6/2006 | Song |
| 7,079,923 | B2 | 7/2006 | Abramson |
| 7,082,350 | B2 | 7/2006 | Skoog |
| D526,753 | S | 8/2006 | Tani |
| 7,085,624 | B2 | 8/2006 | Aldred |
| 7,103,449 | B2 | 9/2006 | Woo |
| 7,113,847 | B2 | 9/2006 | Chmura |
| 7,117,067 | B2 | 10/2006 | McLurkin |
| 7,133,745 | B2 | 11/2006 | Wang |
| 7,134,164 | B2 | 11/2006 | Alton |
| 7,135,992 | B2 | 11/2006 | Karlsson |
| 7,143,696 | B2 | 12/2006 | Rudakevych |
| 7,145,478 | B2 | 12/2006 | Goncalves |
| 7,150,068 | B1 | 12/2006 | Ragner |
| 7,155,308 | B2 | 12/2006 | Jones |
| 7,155,309 | B2 | 12/2006 | Peless |
| 7,162,338 | B2 | 1/2007 | Goncalves |
| 7,167,775 | B2 | 1/2007 | Abramson |
| 7,173,391 | B2 | 2/2007 | Jones |
| 7,174,238 | B1 | 2/2007 | Zweig |
| 7,177,737 | B2 | 2/2007 | Karlsson |
| 7,184,586 | B2 | 2/2007 | Jeon |
| 7,185,396 | B2 | 3/2007 | Im |
| 7,185,397 | B2 | 3/2007 | Stuchlik |
| 7,188,000 | B2 | 3/2007 | Chiappetta |
| 7,196,487 | B2 | 3/2007 | Jones |
| 7,199,711 | B2 | 4/2007 | Field |
| 7,200,892 | B2 | 4/2007 | Kim |
| 7,202,630 | B2 | 4/2007 | Dan |
| 7,206,677 | B2 | 4/2007 | Hulden |
| 7,207,081 | B2 | 4/2007 | Gerber |
| 7,208,892 | B2 | 4/2007 | Tondra |
| 7,213,298 | B2 | 5/2007 | Cipolla |
| 7,213,663 | B2 | 5/2007 | Kim |
| 7,222,390 | B2 | 5/2007 | Cipolla |
| 7,225,500 | B2 | 6/2007 | Diehl |
| 7,237,298 | B2 | 7/2007 | Reindle |
| 7,240,396 | B2 | 7/2007 | Thomas, Sr. |
| 7,246,405 | B2 | 7/2007 | Yan |
| 7,248,951 | B2 | 7/2007 | Hulden |
| 7,251,853 | B2 | 8/2007 | Park |
| 7,254,464 | B1 | 8/2007 | McLurkin |
| 7,254,859 | B2 | 8/2007 | Gerber |
| 7,269,877 | B2 | 9/2007 | Tondra |
| 7,272,467 | B2 | 9/2007 | Goncalves |
| 7,272,868 | B2 | 9/2007 | Im |
| 7,274,167 | B2 | 9/2007 | Kim |
| 7,275,280 | B2 | 10/2007 | Haegermarck |
| 7,288,912 | B2 | 10/2007 | Landry |
| D556,961 | S | 12/2007 | Swyst |
| 7,303,776 | B2 | 12/2007 | Sus |
| 7,324,870 | B2 | 1/2008 | Lee |
| 7,331,436 | B1 | 2/2008 | Pack |
| 7,332,890 | B2 | 2/2008 | Cohen |
| 7,343,221 | B2 | 3/2008 | Ann |
| 7,343,719 | B2 | 3/2008 | Sus |
| 7,346,428 | B1 | 3/2008 | Huffman |
| 7,349,759 | B2 | 3/2008 | Peless |
| 7,359,766 | B2 | 4/2008 | Jeon |

(56) References Cited

U.S. PATENT DOCUMENTS

| | | | |
|---|---|---|---|
| 7,363,994 | B1 | 4/2008 | DeFazio |
| 7,369,460 | B2 | 5/2008 | Chiappetta |
| 7,372,004 | B2 | 5/2008 | Buchner |
| 7,388,343 | B2 | 6/2008 | Jones |
| 7,389,156 | B2 | 6/2008 | Ziegler |
| 7,389,166 | B2 | 6/2008 | Harwig |
| 7,403,360 | B2 | 7/2008 | Cunningham |
| 7,412,748 | B2 | 8/2008 | Lee |
| 7,417,404 | B2 | 8/2008 | Lee |
| 7,418,762 | B2 | 9/2008 | Arai |
| 7,424,766 | B2 | 9/2008 | Reindle |
| 7,429,843 | B2 | 9/2008 | Jones |
| 7,430,455 | B2 | 9/2008 | Casey |
| 7,438,766 | B2 | 10/2008 | Song |
| 7,441,298 | B2 | 10/2008 | Svendsen |
| 7,444,206 | B2 | 10/2008 | Abramson |
| 7,448,113 | B2 | 11/2008 | Jones |
| 7,459,871 | B2 | 12/2008 | Landry |
| 7,464,157 | B2 | 12/2008 | Okude |
| 7,474,941 | B2 | 1/2009 | Kim |
| 7,480,958 | B2 | 1/2009 | Song |
| 7,480,960 | B2 | 1/2009 | Kim |
| D586,959 | S | 2/2009 | Geringer |
| 7,489,277 | B2 | 2/2009 | Sung |
| 7,489,985 | B2 | 2/2009 | Ko |
| 7,499,774 | B2 | 3/2009 | Barrett |
| 7,499,775 | B2 | 3/2009 | Filippov |
| 7,499,776 | B2 | 3/2009 | Allard |
| 7,499,804 | B2 | 3/2009 | Svendsen |
| 7,503,096 | B2 | 3/2009 | Lin |
| 7,515,991 | B2 | 4/2009 | Egawa |
| D593,265 | S | 5/2009 | Carr |
| 7,539,557 | B2 | 5/2009 | Yamauchi |
| 7,546,891 | B2 | 6/2009 | Won |
| 7,546,912 | B1 | 6/2009 | Pack |
| 7,555,363 | B2 | 6/2009 | Augenbraun |
| 7,556,108 | B2 | 7/2009 | Won |
| 7,559,269 | B2 | 7/2009 | Rudakevych |
| 7,564,571 | B2 | 7/2009 | Karabassi |
| 7,566,839 | B2 | 7/2009 | Hukuba |
| 7,567,052 | B2 | 7/2009 | Jones |
| 7,568,259 | B2 | 8/2009 | Yan |
| 7,568,536 | B2 | 8/2009 | Yu |
| 7,571,511 | B2 | 8/2009 | Jones |
| 7,573,403 | B2 | 8/2009 | Goncalves |
| 7,574,282 | B2 | 8/2009 | Petersson |
| 7,578,020 | B2 | 8/2009 | Jaworski |
| 7,579,803 | B2 | 8/2009 | Jones |
| 7,581,282 | B2 | 9/2009 | Woo |
| 7,597,162 | B2 | 10/2009 | Won |
| 7,600,521 | B2 | 10/2009 | Woo |
| 7,600,593 | B2 | 10/2009 | Filippov |
| 7,603,744 | B2 | 10/2009 | Reindle |
| 7,604,675 | B2 | 10/2009 | Makarov |
| 7,610,651 | B2 | 11/2009 | Baek |
| 7,613,543 | B2 | 11/2009 | Petersson |
| 7,620,476 | B2 | 11/2009 | Morse |
| 7,636,982 | B2 | 12/2009 | Jones |
| 7,647,144 | B2 | 1/2010 | Haegermarck |
| 7,650,666 | B2 | 1/2010 | Jang |
| 7,654,348 | B2 | 2/2010 | Ohm |
| 7,660,650 | B2 | 2/2010 | Kawagoe |
| 7,663,333 | B2 | 2/2010 | Jones |
| 7,673,367 | B2 | 3/2010 | Kim |
| 7,679,532 | B2 | 3/2010 | Karlsson |
| 7,688,676 | B2 | 3/2010 | Chiappetta |
| 7,693,654 | B1 | 4/2010 | Dietsch |
| 7,697,141 | B2 | 4/2010 | Jones |
| 7,706,917 | B1 | 4/2010 | Chiappetta |
| 7,706,921 | B2 | 4/2010 | Jung |
| 7,709,497 | B2 | 5/2010 | Christensen, IV |
| 7,711,450 | B2 | 5/2010 | Im |
| 7,720,572 | B2 | 5/2010 | Ziegler |
| 7,721,829 | B2 | 5/2010 | Lee |
| 7,729,801 | B2 | 6/2010 | Abramson |
| 7,749,294 | B2 | 7/2010 | Oh |
| 7,751,940 | B2 | 7/2010 | Lee |
| 7,761,954 | B2 | 7/2010 | Ziegler |
| 7,765,635 | B2 | 8/2010 | Park |
| 7,765,638 | B2 | 8/2010 | Pineschi et al. |
| 7,769,490 | B2 | 8/2010 | Abramson |
| 7,774,158 | B2 | 8/2010 | Domingues Goncalves |
| 7,779,504 | B2 | 8/2010 | Lee |
| 7,780,796 | B2 | 8/2010 | Shim |
| 7,784,139 | B2 | 8/2010 | Sawalski |
| 7,784,570 | B2 | 8/2010 | Couture |
| 7,785,544 | B2 | 8/2010 | Alward |
| 7,787,991 | B2 | 8/2010 | Jeung |
| 7,793,614 | B2 | 9/2010 | Ericsson |
| 7,801,645 | B2 | 9/2010 | Taylor |
| 7,805,220 | B2 | 9/2010 | Taylor |
| 7,827,653 | B1 | 11/2010 | Liu |
| 7,832,048 | B2 | 11/2010 | Harwig |
| 7,835,529 | B2 | 11/2010 | Hernandez |
| 7,843,431 | B2 | 11/2010 | Robbins |
| 7,844,364 | B2 | 11/2010 | McLurkin |
| 7,849,555 | B2 | 12/2010 | Hahm |
| 7,856,291 | B2 | 12/2010 | Jung |
| 7,860,608 | B2 | 12/2010 | Lee |
| 7,861,365 | B2 | 1/2011 | Sun |
| 7,861,366 | B2 | 1/2011 | Hahm |
| 7,873,437 | B2 | 1/2011 | Aldred |
| 7,877,166 | B2 | 1/2011 | Harwig |
| 7,886,399 | B2 | 2/2011 | Dayton |
| 7,890,210 | B2 | 2/2011 | Choi |
| 7,891,045 | B2 | 2/2011 | Kim |
| 7,891,289 | B2 | 2/2011 | Day |
| 7,891,446 | B2 | 2/2011 | Couture |
| 7,894,951 | B2 | 2/2011 | Norris |
| 7,916,931 | B2 | 3/2011 | Lee |
| 7,920,941 | B2 | 4/2011 | Park |
| 7,921,506 | B2 | 4/2011 | Baek |
| 7,926,598 | B2 | 4/2011 | Rudakevych |
| 7,934,571 | B2 | 5/2011 | Chiu |
| 7,937,800 | B2 | 5/2011 | Yan |
| 7,942,107 | B2 | 5/2011 | Vosburgh |
| 7,957,837 | B2 | 6/2011 | Ziegler |
| 7,962,997 | B2 | 6/2011 | Chung |
| 7,966,339 | B2 | 6/2011 | Kim |
| 7,975,790 | B2 | 7/2011 | Kim |
| 7,979,175 | B2 | 7/2011 | Allard |
| 7,979,945 | B2 | 7/2011 | Dayton |
| 7,981,455 | B2 | 7/2011 | Sus |
| 7,997,118 | B2 | 8/2011 | Mecca |
| 8,001,651 | B2 | 8/2011 | Chang |
| 8,007,221 | B1 | 8/2011 | More |
| 8,010,229 | B2 | 8/2011 | Kim |
| 8,019,223 | B2 | 9/2011 | Hudson |
| 8,020,657 | B2 | 9/2011 | Allard |
| 8,032,978 | B2 | 10/2011 | Haegermarck |
| 8,034,390 | B2 | 10/2011 | Sus |
| 8,042,663 | B1 | 10/2011 | Pack |
| 8,046,103 | B2 | 10/2011 | Abramson |
| 8,061,461 | B2 | 11/2011 | Couture |
| 8,065,778 | B2 | 11/2011 | Kim |
| 8,073,439 | B2 | 12/2011 | Stromberg |
| 8,074,752 | B2 | 12/2011 | Rudakevych |
| 8,078,338 | B2 | 12/2011 | Pack |
| 8,079,432 | B2 | 12/2011 | Ohm |
| 8,082,836 | B2 | 12/2011 | More |
| 8,086,419 | B2 | 12/2011 | Goncalves |
| 8,087,117 | B2 | 1/2012 | Kapoor |
| 8,095,238 | B2 | 1/2012 | Jones |
| 8,095,336 | B2 | 1/2012 | Goncalves |
| 8,107,318 | B2 | 1/2012 | Chiappetta |
| 8,108,092 | B2 | 1/2012 | Phillips |
| 8,109,191 | B1 | 2/2012 | Rudakevych |
| 8,112,942 | B2 | 2/2012 | Bohm |
| 8,113,304 | B2 | 2/2012 | Won |
| 8,122,982 | B2 | 2/2012 | Morey |
| 8,127,396 | B2 | 3/2012 | Mangiardi |
| 8,127,399 | B2 | 3/2012 | Dilger |
| 8,127,704 | B2 | 3/2012 | Vosburgh |
| 8,136,200 | B2 | 3/2012 | Splinter |

(56) References Cited

U.S. PATENT DOCUMENTS

| | | | |
|---|---|---|---|
| 8,150,650 | B2 | 4/2012 | Goncalves |
| D659,311 | S | 5/2012 | Geringer |
| 8,166,904 | B2 | 5/2012 | Israel |
| 8,195,333 | B2 | 6/2012 | Ziegler |
| 8,196,251 | B2 | 6/2012 | Lynch |
| 8,199,109 | B2 | 6/2012 | Robbins |
| 8,200,600 | B2 | 6/2012 | Rosenstein |
| 8,200,700 | B2 | 6/2012 | Moore |
| 8,237,389 | B2 | 8/2012 | Fitch |
| 8,237,920 | B2 | 8/2012 | Jones |
| 8,239,992 | B2 | 8/2012 | Schnittman |
| 8,244,469 | B2 | 8/2012 | Cheung |
| 8,253,368 | B2 | 8/2012 | Landry |
| 8,255,092 | B2 | 8/2012 | Phillips |
| 8,256,542 | B2 | 9/2012 | Couture |
| 8,265,793 | B2 | 9/2012 | Cross |
| 8,274,406 | B2 | 9/2012 | Karlsson |
| 8,281,703 | B2 | 10/2012 | Moore |
| 8,281,731 | B2 | 10/2012 | Vosburgh |
| 8,290,619 | B2 | 10/2012 | McLurkin |
| 8,292,007 | B2 | 10/2012 | DeFazio |
| 8,295,125 | B2 | 10/2012 | Chiappetta |
| D670,877 | S | 11/2012 | Geringer |
| 8,308,529 | B2 | 11/2012 | DAmbra |
| 8,311,674 | B2 | 11/2012 | Abramson |
| 8,316,971 | B2 | 11/2012 | Couture |
| 8,318,499 | B2 | 11/2012 | Fritchie |
| D672,928 | S | 12/2012 | Swett |
| 8,322,470 | B2 | 12/2012 | Ohm |
| 8,326,469 | B2 | 12/2012 | Phillips |
| 8,327,960 | B2 | 12/2012 | Couture |
| 8,336,479 | B2 | 12/2012 | Vosburgh |
| 8,342,271 | B2 | 1/2013 | Filippov |
| 8,347,088 | B2 | 1/2013 | Moore |
| 8,347,444 | B2 | 1/2013 | Schnittman |
| 8,350,810 | B2 | 1/2013 | Robbins |
| 8,353,373 | B2 | 1/2013 | Rudakevych |
| 8,364,309 | B1 | 1/2013 | Bailey |
| 8,364,310 | B2 | 1/2013 | Jones |
| 8,365,848 | B2 | 2/2013 | Won |
| 8,368,339 | B2 | 2/2013 | Jones |
| 8,370,985 | B2 | 2/2013 | Schnittman |
| 8,374,721 | B2 | 2/2013 | Halloran |
| 8,375,838 | B2 | 2/2013 | Rudakevych |
| 8,378,613 | B2 | 2/2013 | Landry |
| 8,380,350 | B2 | 2/2013 | Ozick |
| 8,382,906 | B2 | 2/2013 | Konandreas |
| 8,386,081 | B2 | 2/2013 | Landry |
| 8,387,193 | B2 | 3/2013 | Ziegler |
| 8,390,251 | B2 | 3/2013 | Cohen |
| 8,392,021 | B2 | 3/2013 | Konandreas |
| 8,396,592 | B2 | 3/2013 | Jones |
| 8,396,611 | B2 | 3/2013 | Phillips |
| 8,402,586 | B2 | 3/2013 | Lavabre |
| 8,408,956 | B1 | 4/2013 | Vosburgh |
| 8,412,377 | B2 | 4/2013 | Casey |
| 8,413,752 | B2 | 4/2013 | Page |
| 8,417,188 | B1 | 4/2013 | Vosburgh |
| 8,417,383 | B2 | 4/2013 | Ozick |
| 8,418,303 | B2 | 4/2013 | Kapoor |
| 8,418,642 | B2 | 4/2013 | Vosburgh |
| 8,428,778 | B2 | 4/2013 | Landry |
| 8,433,442 | B2 | 4/2013 | Friedman |
| D682,362 | S | 5/2013 | Mozeika |
| 8,438,694 | B2 | 5/2013 | Kim |
| 8,438,695 | B2 | 5/2013 | Gilbert, Jr. |
| 8,438,698 | B2 | 5/2013 | Kim |
| 8,447,440 | B2 | 5/2013 | Phillips |
| 8,447,613 | B2 | 5/2013 | Hussey |
| 8,452,448 | B2 | 5/2013 | Pack |
| 8,453,289 | B2 | 6/2013 | Lynch |
| 8,456,125 | B2 | 6/2013 | Landry |
| 8,461,803 | B2 | 6/2013 | Cohen |
| 8,463,438 | B2 | 6/2013 | Jones |
| 8,473,140 | B2 | 6/2013 | Norris |
| 8,474,090 | B2 | 7/2013 | Jones |
| 8,478,442 | B2 | 7/2013 | Casey |
| 8,485,330 | B2 | 7/2013 | Pack |
| 8,505,158 | B2 | 8/2013 | Han |
| 8,508,388 | B2 | 8/2013 | Karlsson |
| 8,515,578 | B2 | 8/2013 | Chiappetta |
| 8,516,651 | B2 | 8/2013 | Jones |
| 8,525,995 | B2 | 9/2013 | Jones |
| 8,527,113 | B2 | 9/2013 | Yamauchi |
| 8,528,157 | B2 | 9/2013 | Schnittman |
| 8,528,162 | B2 | 9/2013 | Tang |
| 8,528,673 | B2 | 9/2013 | More |
| 8,532,822 | B2 | 9/2013 | Abramson |
| 8,533,144 | B1 | 9/2013 | Reeser |
| 8,534,983 | B2 | 9/2013 | Schoenfeld |
| 8,543,562 | B2 | 9/2013 | Mule |
| 8,548,626 | B2 | 10/2013 | Steitz |
| 8,551,254 | B2 | 10/2013 | Dayton |
| 8,551,421 | B2 | 10/2013 | Luchinger |
| 8,565,920 | B2 | 10/2013 | Casey |
| 8,572,799 | B2 | 11/2013 | Won |
| 8,584,305 | B2 | 11/2013 | Won |
| 8,584,306 | B2 | 11/2013 | Chung |
| 8,584,307 | B2 | 11/2013 | Won |
| 8,594,840 | B1 | 11/2013 | Chiappetta |
| 8,598,829 | B2 | 12/2013 | Landry |
| 8,599,645 | B2 | 12/2013 | Chiappetta |
| 8,600,553 | B2 | 12/2013 | Svendsen |
| 8,606,401 | B2 | 12/2013 | Ozick |
| 8,634,956 | B1 | 1/2014 | Chiappetta |
| 8,634,958 | B1 | 1/2014 | Chiappetta |
| 8,666,523 | B2 | 3/2014 | Kim |
| 8,671,513 | B2 | 3/2014 | Yoo et al. |
| 8,732,895 | B2 | 5/2014 | Cunningham |
| 8,741,013 | B2 | 6/2014 | Swett et al. |
| 8,743,286 | B2 | 6/2014 | Hasegawa |
| 8,745,194 | B2 | 6/2014 | Uribe-Etxebarria Jimenez |
| 8,755,936 | B2 | 6/2014 | Friedman |
| 8,761,931 | B2 | 6/2014 | Halloran |
| 8,763,200 | B2 | 7/2014 | Kim |
| 8,774,970 | B2 | 7/2014 | Knopow |
| 8,798,791 | B2 | 8/2014 | Li |
| 8,798,792 | B2 | 8/2014 | Park |
| 8,799,258 | B2 | 8/2014 | Mule |
| 8,838,274 | B2 | 9/2014 | Jones |
| 8,839,477 | B2 | 9/2014 | Schnittman |
| 8,843,245 | B2 | 9/2014 | Choe |
| 8,855,914 | B1 | 10/2014 | Alexander |
| 8,874,264 | B1 | 10/2014 | Chiappetta |
| 8,881,339 | B2 | 11/2014 | Gilbert, Jr. et al. |
| 8,924,042 | B2 | 12/2014 | Kim |
| 8,961,695 | B2 | 2/2015 | Romanov |
| 8,985,127 | B2 | 3/2015 | Konandreas |
| 8,996,172 | B2 | 3/2015 | Shah et al. |
| 9,033,079 | B2 | 5/2015 | Shin |
| 9,037,396 | B2 | 5/2015 | Pack |
| 9,144,361 | B2 | 9/2015 | Landry |
| 9,360,300 | B2 | 6/2016 | EnricoDiBernado |
| 9,687,132 | B2 | 6/2017 | Schlischka |
| 10,045,675 | B2 | 8/2018 | Haegermarck |
| 2001/0004719 | A1 | 6/2001 | Sommer |
| 2001/0037163 | A1 | 11/2001 | Allard |
| 2002/0016649 | A1 | 2/2002 | Jones |
| 2002/0091466 | A1 | 7/2002 | Song |
| 2002/0108635 | A1 | 8/2002 | Marrero |
| 2002/0121288 | A1 | 9/2002 | Marrero |
| 2002/0121561 | A1 | 9/2002 | Marrero |
| 2002/0164932 | A1 | 11/2002 | Kamimura |
| 2002/0174506 | A1 | 11/2002 | Wallach |
| 2002/0185071 | A1 | 12/2002 | Guo |
| 2002/0189871 | A1 | 12/2002 | Won |
| 2003/0000034 | A1 | 1/2003 | Welsh |
| 2003/0025472 | A1 | 2/2003 | Jones |
| 2003/0030398 | A1 | 2/2003 | Jacobs |
| 2003/0120972 | A1 | 6/2003 | Matsushima |
| 2003/0159223 | A1 | 8/2003 | Plankenhorn |
| 2003/0167000 | A1 | 9/2003 | Mullick |
| 2003/0229421 | A1 | 12/2003 | Chmura |
| 2004/0020000 | A1 | 2/2004 | Jones |

(56) References Cited

U.S. PATENT DOCUMENTS

2004/0031111 A1 2/2004 Porchia
2004/0031121 A1 2/2004 Martin
2004/0034952 A1 2/2004 Ho
2004/0049877 A1 3/2004 Jones
2004/0049878 A1 3/2004 Thomas
2004/0074038 A1 4/2004 Im
2004/0074039 A1 4/2004 Kim
2004/0098167 A1 5/2004 Yi
2004/0111184 A1 6/2004 Chiappetta
2004/0111827 A1 6/2004 Im
2004/0167667 A1 8/2004 Goncalves
2004/0181896 A1 9/2004 Egawa
2004/0182839 A1 9/2004 Denney
2004/0182840 A1 9/2004 Denney
2004/0185011 A1 9/2004 Alexander
2004/0187249 A1 9/2004 Jones
2004/0207355 A1 10/2004 Jones
2004/0208212 A1 10/2004 Denney
2004/0210343 A1 10/2004 Kim
2004/0220707 A1 11/2004 Pallister
2005/0010331 A1 1/2005 Taylor
2005/0015912 A1 1/2005 Kim
2005/0015915 A1 1/2005 Thomas
2005/0028315 A1 2/2005 Thomas
2005/0028316 A1 2/2005 Thomas
2005/0042151 A1 2/2005 Alward
2005/0065662 A1 3/2005 Reindle
2005/0085947 A1 4/2005 MichaelAldred
2005/0088643 A1 4/2005 Anderson
2005/0156562 A1 7/2005 Cohen
2005/0166354 A1 8/2005 NaoyaUehigashi
2005/0172435 A1* 8/2005 Bernini ..... A46B 5/04
15/167.1
2005/0191949 A1 9/2005 Kamimura
2005/0217061 A1 10/2005 Reindle
2005/0223514 A1 10/2005 Stuchlik
2005/0229340 A1 10/2005 Sawalski
2005/0230166 A1 10/2005 Petersson
2005/0234611 A1 10/2005 Uehigashi
2005/0251292 A1 11/2005 Casey
2005/0251457 A1 11/2005 Kashiwagi
2005/0251947 A1 11/2005 Lee
2005/0267629 A1 12/2005 Petersson
2005/0278888 A1 12/2005 Reindle
2005/0287038 A1 12/2005 Dubrovsky
2006/0009879 A1 1/2006 Lynch
2006/0010799 A1 1/2006 Bohm
2006/0020369 A1 1/2006 Taylor
2006/0028306 A1 2/2006 Hukuba
2006/0032013 A1 2/2006 Kim
2006/0045981 A1 3/2006 Tsushi
2006/0076039 A1 4/2006 Song et al.
2006/0095158 A1 5/2006 Lee
2006/0136096 A1 6/2006 Chiappetta
2006/0144834 A1 7/2006 Denney
2006/0178777 A1 8/2006 Park
2006/0190133 A1 8/2006 Konandreas
2006/0190134 A1 8/2006 Ziegler
2006/0190146 A1 8/2006 Morse
2006/0195015 A1 8/2006 Mullick
2006/0200281 A1 9/2006 Ziegler
2006/0213025 A1 9/2006 Sawalski
2006/0235570 A1 10/2006 Jung
2006/0235585 A1 10/2006 HirotoTanaka
2006/0236492 A1 10/2006 KazuyaSudo
2006/0288519 A1 12/2006 Jaworski
2006/0293788 A1 12/2006 Pogodin
2007/0016328 A1 1/2007 Ziegler
2007/0021867 A1 1/2007 Woo
2007/0059441 A1 3/2007 Greer
2007/0061040 A1 3/2007 Augenbraun
2007/0114975 A1 5/2007 Cohen
2007/0118248 A1 5/2007 Lee et al.
2007/0124890 A1 6/2007 Erko
2007/0143950 A1 6/2007 Lin
2007/0156286 A1 7/2007 Yamauchi
2007/0179670 A1 8/2007 Chiappetta
2007/0189347 A1 8/2007 Denney
2007/0204426 A1 9/2007 Nakagawa
2007/0213892 A1 9/2007 Jones
2007/0214601 A1 9/2007 Chung
2007/0234492 A1 10/2007 Svendsen
2007/0244610 A1 10/2007 Ozick
2007/0266508 A1 11/2007 Jones
2007/0267230 A1 11/2007 Won
2007/0267570 A1 11/2007 Park
2007/0267998 A1 11/2007 Cohen
2007/0273864 A1 11/2007 Cho
2007/0276541 A1 11/2007 Sawasaki
2007/0285041 A1 12/2007 Jones
2007/0289267 A1 12/2007 Makarov
2007/0290649 A1 12/2007 Jones
2008/0000041 A1 1/2008 Jones
2008/0000042 A1 1/2008 Jones
2008/0001566 A1 1/2008 Jones
2008/0007203 A1 1/2008 Cohen
2008/0009964 A1 1/2008 Bruemmer et al.
2008/0015738 A1 1/2008 Casey
2008/0016631 A1 1/2008 Casey
2008/0037170 A1 2/2008 Saliba
2008/0039974 A1 2/2008 Sandin
2008/0047092 A1 2/2008 Schnittman
2008/0051953 A1 2/2008 Jones
2008/0007193 A1 3/2008 Bow
2008/0052846 A1 3/2008 Kapoor
2008/0058987 A1 3/2008 Ozick
2008/0063400 A1 3/2008 Hudson
2008/0065265 A1 3/2008 Ozick
2008/0077278 A1 3/2008 Park
2008/0084174 A1 4/2008 Jones
2008/0086241 A1 4/2008 Phillips
2008/0091304 A1 4/2008 Ozick
2008/0091305 A1 4/2008 Svendsen
2008/0093131 A1 4/2008 Couture
2008/0098553 A1 5/2008 Dayton
2008/0105445 A1 5/2008 Dayton
2008/0109126 A1 5/2008 Sandin
2008/0121097 A1 5/2008 Rudakevych
2008/0127445 A1 6/2008 Konandreas
2008/0127446 A1 6/2008 Ziegler
2008/0133052 A1 6/2008 Jones
2008/0134457 A1 6/2008 Morse
2008/0134458 A1 6/2008 Ziegler
2008/0140255 A1 6/2008 Ziegler
2008/0143063 A1 6/2008 Won
2008/0143064 A1 6/2008 Won
2008/0143065 A1 6/2008 DeFazio
2008/0152871 A1 6/2008 Greer
2008/0155768 A1 7/2008 Ziegler
2008/0179115 A1 7/2008 Ohm
2008/0183332 A1 7/2008 Ohm
2008/0184518 A1 8/2008 Taylor
2008/0196946 A1 8/2008 Filippov
2008/0205194 A1 8/2008 Chiappetta
2008/0209665 A1 9/2008 Mangiardi
2008/0221729 A1 9/2008 ErwannLavarec
2008/0223630 A1 9/2008 Couture
2008/0235897 A1 10/2008 Kim
2008/0236907 A1 10/2008 Won
2008/0264456 A1 10/2008 Lynch
2008/0266254 A1 10/2008 Robbins
2008/0276407 A1 11/2008 Schnittman
2008/0276408 A1 11/2008 Gilbert
2008/0281470 A1 11/2008 Gilbert
2008/0282494 A1 11/2008 Won
2008/0294288 A1 11/2008 Yamauchi
2008/0307590 A1 12/2008 Jones
2009/0007366 A1 1/2009 Svendsen
2009/0025155 A1 1/2009 Nishiyama
2009/0030551 A1 1/2009 Hein et al.
2009/0037024 A1 2/2009 Jamieson
2009/0038089 A1 2/2009 Landry
2009/0044370 A1 2/2009 Won
2009/0045766 A1 2/2009 Casey

(56) References Cited

U.S. PATENT DOCUMENTS

2009/0055022 A1 2/2009 Casey
2009/0065271 A1 3/2009 Won
2009/0070946 A1 3/2009 Tamada
2009/0078035 A1 3/2009 Mecca
2009/0107738 A1 4/2009 Won
2009/0125175 A1 5/2009 Park
2009/0126143 A1 5/2009 Haegermarck
2009/0133720 A1 5/2009 Vandenbogert
2009/0145671 A1 6/2009 Filippov
2009/0173553 A1 7/2009 Won
2009/0180668 A1 7/2009 Jones
2009/0226113 A1 9/2009 Matsumoto
2009/0232506 A1 9/2009 Hudson
2009/0241826 A1 10/2009 Vosburgh
2009/0254217 A1 10/2009 Pack
2009/0254218 A1 10/2009 Sandin
2009/0265036 A1 10/2009 Jamieson
2009/0270015 A1 10/2009 DAmbra
2009/0274602 A1 11/2009 Alward
2009/0281661 A1 11/2009 Dooley et al.
2009/0292393 A1 11/2009 Casey
2009/0292884 A1 11/2009 Wang
2009/0314318 A1 12/2009 Chang
2009/0314554 A1 12/2009 Couture
2009/0319083 A1 12/2009 Jones
2010/0001478 A1 1/2010 DeFazio
2010/0011529 A1 1/2010 Won
2010/0037418 A1 2/2010 Hussey
2010/0049364 A1 2/2010 Landry
2010/0049365 A1 2/2010 Jones
2010/0049391 A1 2/2010 Nakano
2010/0063628 A1 3/2010 Landry
2010/0075054 A1 3/2010 Kaneyama
2010/0076600 A1 3/2010 Cross
2010/0078415 A1 4/2010 Denney
2010/0082193 A1 4/2010 Chiappetta
2010/0107355 A1 5/2010 Won
2010/0108098 A1 5/2010 Splinter
2010/0115716 A1 5/2010 Landry
2010/0116566 A1 5/2010 Ohm
2010/0125968 A1 5/2010 Ho
2010/0139029 A1 6/2010 Kim
2010/0139995 A1 6/2010 Rudakevych
2010/0161225 A1 6/2010 Hyung et al.
2010/0173070 A1 7/2010 Niu
2010/0206336 A1 8/2010 Souid
2010/0217436 A1 8/2010 Jones
2010/0257690 A1 10/2010 Jones
2010/0257691 A1 10/2010 Jones
2010/0263142 A1 10/2010 Jones
2010/0263158 A1 10/2010 Jones
2010/0268384 A1 10/2010 Jones
2010/0275405 A1 11/2010 Morse
2010/0286791 A1 11/2010 Goldsmith
2010/0305752 A1 12/2010 Abramson
2010/0312429 A1 12/2010 Jones
2010/0313910 A1 12/2010 Lee
2010/0313912 A1 12/2010 Han
2011/0000363 A1 1/2011 More
2011/0004339 A1 1/2011 Ozick
2011/0010873 A1 1/2011 Kim
2011/0077802 A1 3/2011 Halloran
2011/0082668 A1 4/2011 Escrig
2011/0088609 A1 4/2011 Vosburgh
2011/0109549 A1 5/2011 Robbins
2011/0125323 A1 5/2011 Gutmann et al.
2011/0131741 A1 6/2011 Jones
2011/0154589 A1 6/2011 Reindle
2011/0202175 A1 8/2011 Romanov
2011/0209726 A1 9/2011 Dayton
2011/0252594 A1 10/2011 Blouin
2011/0258789 A1 10/2011 Lavabre
2011/0271469 A1 11/2011 Ziegler
2011/0277269 A1 11/2011 Kim
2011/0286886 A1 11/2011 Luchinger
2011/0288684 A1 11/2011 Farlow
2012/0011668 A1 1/2012 Schnittman
2012/0011669 A1 1/2012 Schnittman
2012/0011676 A1 1/2012 Jung
2012/0011677 A1 1/2012 Jung
2012/0011992 A1 1/2012 Rudakevych
2012/0036659 A1 2/2012 Ziegler
2012/0047676 A1 3/2012 Jung
2012/0049798 A1 3/2012 Cohen
2012/0079670 A1 4/2012 Yoon
2012/0083924 A1 4/2012 Jones
2012/0084934 A1 4/2012 Li
2012/0084937 A1 4/2012 Won
2012/0084938 A1 4/2012 Fu
2012/0085368 A1 4/2012 Landry
2012/0090133 A1 4/2012 Kim
2012/0095619 A1 4/2012 Pack
2012/0096656 A1 4/2012 Jung
2012/0097783 A1 4/2012 Pack
2012/0101661 A1 4/2012 Phillips
2012/0102670 A1 5/2012 Jang
2012/0109423 A1 5/2012 Pack
2012/0110755 A1 5/2012 Liu
2012/0118216 A1 5/2012 Vosburgh
2012/0125363 A1 5/2012 Kim
2012/0137464 A1 6/2012 Thatcher
2012/0137949 A1 6/2012 Vosburgh
2012/0151709 A1 6/2012 Tang
2012/0152280 A1 6/2012 Bosses
2012/0152877 A1 6/2012 Tadayon
2012/0159725 A1 6/2012 Kapoor
2012/0166024 A1 6/2012 Phillips
2012/0167917 A1 7/2012 Gilbert
2012/0169497 A1 7/2012 Schnittman
2012/0173018 A1 7/2012 Allen
2012/0173070 A1 7/2012 Schnittman
2012/0180254 A1 7/2012 Morse
2012/0180712 A1 7/2012 Vosburgh
2012/0181099 A1 7/2012 Moon
2012/0182392 A1 7/2012 Kearns
2012/0183382 A1 7/2012 Couture
2012/0185091 A1 7/2012 Field
2012/0185094 A1 7/2012 Rosenstein
2012/0185095 A1 7/2012 Rosenstein
2012/0185096 A1 7/2012 Rosenstein
2012/0192898 A1 8/2012 Lynch
2012/0194395 A1 8/2012 Williams
2012/0197439 A1 8/2012 Wang
2012/0197464 A1 8/2012 Wang
2012/0199006 A1 8/2012 Swett
2012/0199407 A1 8/2012 Morey
2012/0200149 A1 8/2012 Rudakevych
2012/0222224 A1 9/2012 Yoon
2012/0246862 A1 10/2012 Landry
2012/0260443 A1 10/2012 Lindgren
2012/0260861 A1 10/2012 Lindgren
2012/0261204 A1 10/2012 Won
2012/0265346 A1 10/2012 Gilbert
2012/0265391 A1 10/2012 Letsky
2012/0268587 A1 10/2012 Robbins
2012/0281829 A1 11/2012 Rudakevych
2012/0298029 A1 11/2012 Vosburgh
2012/0303160 A1 11/2012 Ziegler
2012/0311810 A1 12/2012 Gilbert
2012/0312221 A1 12/2012 Vosburgh
2012/0317745 A1 12/2012 Jung
2012/0322349 A1 12/2012 Josi
2013/0015596 A1 1/2013 Mozeika
2013/0025085 A1 1/2013 Kim
2013/0031734 A1 2/2013 Porat
2013/0032078 A1 2/2013 Yahnker
2013/0035793 A1 2/2013 Neumann
2013/0047368 A1 2/2013 Tran
2013/0054029 A1 2/2013 Huang
2013/0054129 A1 2/2013 Wong
2013/0060357 A1 3/2013 Li
2013/0060379 A1 3/2013 Choe
2013/0070563 A1 3/2013 Chiappetta
2013/0081218 A1 4/2013 Kim

(56) References Cited

U.S. PATENT DOCUMENTS

| | | | |
|---|---|---|---|
| 2013/0085603 | A1 | 4/2013 | Chiappetta |
| 2013/0086760 | A1 | 4/2013 | Han |
| 2013/0092190 | A1 | 4/2013 | Yoon |
| 2013/0098402 | A1 | 4/2013 | Yoon et al. |
| 2013/0103194 | A1 | 4/2013 | Jones |
| 2013/0105233 | A1 | 5/2013 | Couture |
| 2013/0117952 | A1 | 5/2013 | Schnittman |
| 2013/0118524 | A1 | 5/2013 | Konandreas |
| 2013/0138337 | A1 | 5/2013 | Pack |
| 2013/0145572 | A1 | 6/2013 | Schregardus |
| 2013/0152724 | A1 | 6/2013 | Mozeika |
| 2013/0160226 | A1 | 6/2013 | Lee |
| 2013/0166107 | A1 | 6/2013 | Robbins |
| 2013/0174371 | A1 | 7/2013 | Jones |
| 2013/0204463 | A1 | 8/2013 | Chiappetta |
| 2013/0204465 | A1 | 8/2013 | Phillips |
| 2013/0204483 | A1 | 8/2013 | Sung |
| 2013/0205520 | A1 | 8/2013 | Kapoor |
| 2013/0206170 | A1 | 8/2013 | Svendsen |
| 2013/0206177 | A1 | 8/2013 | Burlutskiy |
| 2013/0211589 | A1 | 8/2013 | Landry |
| 2013/0214498 | A1 | 8/2013 | DeFazio |
| 2013/0226344 | A1 | 8/2013 | Wong |
| 2013/0227801 | A1 | 9/2013 | Kim |
| 2013/0227812 | A1 | 9/2013 | Kim |
| 2013/0228198 | A1 | 9/2013 | Hung |
| 2013/0228199 | A1 | 9/2013 | Hung |
| 2013/0231779 | A1 | 9/2013 | Purkayastha |
| 2013/0231819 | A1 | 9/2013 | Hung |
| 2013/0232702 | A1 | 9/2013 | Baek |
| 2013/0239870 | A1 | 9/2013 | Hudson |
| 2013/0241217 | A1 | 9/2013 | Hickey |
| 2013/0253701 | A1 | 9/2013 | Halloran |
| 2013/0256042 | A1 | 10/2013 | Rudakevych |
| 2013/0268118 | A1 | 10/2013 | Grinstead |
| 2013/0269148 | A1 | 10/2013 | Chiu |
| 2013/0273252 | A1 | 10/2013 | Miyamoto |
| 2013/0298350 | A1 | 11/2013 | Schnittman |
| 2013/0310978 | A1 | 11/2013 | Ozick |
| 2013/0325178 | A1 | 12/2013 | Jones |
| 2013/0331987 | A1 | 12/2013 | Karlsson |
| 2013/0338525 | A1 | 12/2013 | Allen |
| 2013/0338828 | A1 | 12/2013 | Chiappetta |
| 2013/0338831 | A1 | 12/2013 | Noh |
| 2013/0340201 | A1 | 12/2013 | Jang et al. |
| 2014/0016469 | A1 | 1/2014 | Ho |
| 2014/0026339 | A1 | 1/2014 | Konandreas |
| 2014/0053351 | A1 | 2/2014 | Kapoor |
| 2014/0109339 | A1 | 4/2014 | Won |
| 2014/0123325 | A1 | 5/2014 | Jung |
| 2014/0130272 | A1 | 5/2014 | Won |
| 2014/0142757 | A1 | 5/2014 | Ziegler |
| 2014/0167931 | A1 | 6/2014 | Lee |
| 2014/0180968 | A1 | 6/2014 | Song |
| 2014/0207280 | A1 | 7/2014 | Duffley |
| 2014/0207281 | A1 | 7/2014 | Angle |
| 2014/0207282 | A1 | 7/2014 | Angle |
| 2014/0238440 | A1 | 8/2014 | Dayton |
| 2014/0249671 | A1 | 9/2014 | Halloran |
| 2014/0283326 | A1 | 9/2014 | Song |
| 2015/0005937 | A1 | 1/2015 | Ponulak |
| 2015/0032259 | A1 | 1/2015 | Kim |
| 2015/0033488 | A1* | 2/2015 | Varila ..... A61C 17/222 15/167.1 |
| 2015/0039127 | A1 | 2/2015 | Matsumoto |
| 2015/0057800 | A1 | 2/2015 | Cohen |
| 2015/0120056 | A1 | 4/2015 | Noh et al. |
| 2015/0185322 | A1 | 7/2015 | Haegermarck |
| 2015/0197012 | A1 | 7/2015 | Schnittman |
| 2015/0206015 | A1 | 7/2015 | Ramalingam |
| 2015/0265122 | A1 | 9/2015 | Han et al. |
| 2016/0202703 | A1 | 7/2016 | Matsubara |
| 2016/0306359 | A1 | 10/2016 | MagnusLindhe |
| 2016/0316982 | A1 | 11/2016 | Kim et al. |
| 2017/0273521 | A1 | 9/2017 | Klintemyr et al. |
| 2017/0273524 | A1 | 9/2017 | Klintemyr et al. |
| 2018/0103812 | A1 | 4/2018 | Lee et al. |

FOREIGN PATENT DOCUMENTS

| | | | |
|---|---|---|---|
| CN | 1668238 | A | 9/2005 |
| CN | 101161174 | A | 4/2008 |
| CN | 101297267 | A | 10/2008 |
| CN | 102083352 | A | 6/2011 |
| CN | 103027634 | | 4/2013 |
| CN | 103054516 | A | 4/2013 |
| CN | 103491838 | A | 1/2014 |
| CN | 103565373 | A | 2/2014 |
| DE | 3536907 | | 4/1986 |
| DE | 9307500 | | 7/1993 |
| DE | 4211789 | | 10/1993 |
| DE | 4340367 | | 6/1995 |
| DE | 4439427 | A1 | 5/1996 |
| DE | 19849978 | | 5/2000 |
| DE | 202008017137 | U1 | 3/2009 |
| DE | 102010000174 | | 7/2011 |
| DE | 102010000573 | | 9/2011 |
| DE | 102010037672 | | 3/2012 |
| EP | 0142594 | | 5/1985 |
| EP | 0358628 | | 3/1990 |
| EP | 0474542 | | 3/1992 |
| EP | 0569984 | | 11/1993 |
| EP | 0606173 | | 7/1994 |
| EP | 1099143 | | 11/2003 |
| EP | 1360922 | A2 | 11/2003 |
| EP | 1441271 | | 7/2004 |
| EP | 1331537 | | 8/2005 |
| EP | 2050380 | | 4/2009 |
| EP | 1969438 | | 9/2009 |
| EP | 1395888 | | 5/2011 |
| EP | 2316322 | | 5/2011 |
| EP | 2296005 | | 6/2011 |
| EP | 2251757 | | 11/2011 |
| EP | 2417894 | | 2/2012 |
| EP | 2438843 | | 4/2012 |
| EP | 2466411 | A2 | 6/2012 |
| EP | 2561787 | | 2/2013 |
| EP | 2578125 | | 4/2013 |
| EP | 2583609 | | 4/2013 |
| EP | 2604163 | | 6/2013 |
| EP | 2447800 | | 4/2014 |
| EP | 2741483 | | 6/2014 |
| EP | 2772815 | | 9/2014 |
| EP | 2884364 | A1 | 6/2015 |
| EP | 2992803 | A1 | 3/2016 |
| FR | 2999410 | | 6/2014 |
| GB | 1447943 | | 9/1976 |
| GB | 2355523 | | 4/2001 |
| GB | 2382251 | | 5/2003 |
| GB | 2494446 | | 3/2013 |
| JP | 5540959 | | 3/1980 |
| JP | 6286414 | | 4/1987 |
| JP | 62109528 | | 5/1987 |
| JP | 62120510 | | 6/1987 |
| JP | 62152421 | | 7/1987 |
| JP | 62152424 | | 7/1987 |
| JP | 63127310 | A | 5/1988 |
| JP | 63181727 | | 7/1988 |
| JP | 63241610 | | 10/1988 |
| JP | 03162814 | A | 7/1991 |
| JP | 03166074 | | 7/1991 |
| JP | 04260905 | | 9/1992 |
| JP | 0584200 | | 4/1993 |
| JP | 0584210 | | 4/1993 |
| JP | 05084200 | | 4/1993 |
| JP | 05189041 | | 7/1993 |
| JP | 05224745 | | 9/1993 |
| JP | 05228090 | | 9/1993 |
| JP | 064133 | | 1/1994 |
| JP | 0683442 | A | 3/1994 |
| JP | 06125861 | | 5/1994 |
| JP | 06144215 | | 5/1994 |
| JP | 06179145 | | 6/1994 |

(56) References Cited

FOREIGN PATENT DOCUMENTS

| | | | |
|---|---|---|---|
| JP | 075922 | | 1/1995 |
| JP | 0759695 | | 3/1995 |
| JP | 0732752 | B2 | 4/1995 |
| JP | 07129239 | A | 5/1995 |
| JP | 07281742 | | 10/1995 |
| JP | 08089455 | | 4/1996 |
| JP | 08326025 | | 12/1996 |
| JP | 0944240 | | 2/1997 |
| JP | 09150741 | | 6/1997 |
| JP | 09185410 | | 7/1997 |
| JP | 11267074 | | 10/1999 |
| JP | 2001022443 | | 1/2001 |
| JP | 2001187009 | | 7/2001 |
| JP | 2002182742 | A | 6/2002 |
| JP | 2002287824 | A | 10/2002 |
| JP | 2002355204 | | 12/2002 |
| JP | 2002366228 | | 12/2002 |
| JP | 2003280740 | | 10/2003 |
| JP | 2004096253 | | 3/2004 |
| JP | 2004166968 | | 6/2004 |
| JP | 2004198212 | | 7/2004 |
| JP | 2004303134 | A | 10/2004 |
| JP | 2005040597 | A | 2/2005 |
| JP | 2005124753 | A | 5/2005 |
| JP | 2005141636 | A | 6/2005 |
| JP | 2005314116 | A | 11/2005 |
| JP | 2006015113 | A | 1/2006 |
| JP | 2006087507 | | 4/2006 |
| JP | 2006185438 | A | 7/2006 |
| JP | 2006231477 | | 9/2006 |
| JP | 2006314669 | | 11/2006 |
| JP | 2007014369 | A | 1/2007 |
| JP | 2007070658 | | 3/2007 |
| JP | 2007143645 | A | 6/2007 |
| JP | 2007213236 | A | 8/2007 |
| JP | 2007226322 | A | 9/2007 |
| JP | 2007272665 | A | 10/2007 |
| JP | 2008132299 | A | 6/2008 |
| JP | 2008146617 | A | 6/2008 |
| JP | 2008290184 | | 12/2008 |
| JP | 2008543394 | A | 12/2008 |
| JP | 2009500741 | A | 1/2009 |
| JP | 2009509220 | | 3/2009 |
| JP | 2009193240 | A | 8/2009 |
| JP | 2010507169 | A | 3/2010 |
| JP | 2010079869 | A | 4/2010 |
| JP | 2010526594 | | 8/2010 |
| JP | 2010534825 | A | 11/2010 |
| JP | 2011045694 | | 3/2011 |
| JP | 2011253361 | A | 12/2011 |
| JP | 2012216051 | A | 11/2012 |
| JP | 2013041506 | A | 2/2013 |
| JP | 2013089256 | A | 5/2013 |
| JP | 2013247986 | A | 12/2013 |
| JP | 2014023930 | A | 2/2014 |
| KR | 20040096253 | | 11/2004 |
| KR | 20050003112 | | 1/2005 |
| KR | 20070070658 | | 7/2007 |
| KR | 20090028359 | | 3/2009 |
| KR | 101231932 | | 3/2013 |
| NL | 7408667 | | 1/1975 |
| WO | 8804081 | | 6/1988 |
| WO | 9303399 | | 2/1993 |
| WO | 9638770 | | 12/1996 |
| WO | 0036961 | | 6/2000 |
| WO | 0036970 | | 6/2000 |
| WO | 0038025 | | 6/2000 |
| WO | 0182766 | A2 | 11/2001 |
| WO | 03022120 | | 3/2003 |
| WO | 03024292 | | 3/2003 |
| WO | 03026474 | | 4/2003 |
| WO | 2004006034 | A2 | 1/2004 |
| WO | 2004082899 | | 9/2004 |
| WO | 2007008148 | | 1/2007 |
| WO | 2007028049 | | 3/2007 |
| WO | 2007051972 | | 5/2007 |
| WO | 2007065034 | | 6/2007 |
| WO | 2008048260 | | 4/2008 |
| WO | 2009132317 | | 10/2009 |
| WO | 2013105431 | | 7/2013 |
| WO | 2013157324 | | 10/2013 |
| WO | 2014033055 | | 3/2014 |
| WO | 2014151501 | A1 | 9/2014 |
| WO | 2015016580 | | 2/2015 |

OTHER PUBLICATIONS

Notice of Allowance for U.S. Appl. No. 15/101,515, dated Aug. 28, 2018, 11 pages.

International Search Report and Written Opinion of the International Searching Authority for International Application No. PCT/EP2016/060565, dated Feb. 15, 2017, 12 pages.

International Search Report and Written Opinion of the International Searching Authority for International Application No. PCT/EP2016/060571, dated Feb. 7, 2017, 8 pages.

Notice of Allowance for U.S. Appl. No. 14/409,291, dated Sep. 18, 2017, 8 pages.

Notice of Reasons for Rejection for Japanese Application No. 2016-526764, dated Aug. 25, 2017 with translation, 6 pages.

Notification for Reasons for Rejection for Japanese Application No. 2016-526765, dated Aug. 25, 2017 with translation, 7 pages.

Notification of Reasons for Refusal for Japanese Application No. 2016-526756, dated Aug. 10, 2017 with translation, 6 pages.

Notification of Reasons for Refulsal for Japanese Application No. 2016-526759, dated Aug. 24, 2017 with translation, 9 pages.

Final Office Action for U.S. Appl. No. 15/102,017, dated Jun. 14, 2018, 12 pages.

Non Final Office Action for U.S. Appl. No. 15/101,235, dated Jun. 14, 2018, 11 pages.

Chinese Office Action for Chinese Application No. 201380081331.6, dated Mar. 26, 2018 with translation, 27 pages.

Decision of Refusal for Japanese Application No. 2016-526945, dated May 15, 2018 with translation, 5 pages.

Decision of Refusal for Japanese Application No. 2016-526875, dated May 15, 2016 with translation, 6 pages.

Notification of Reasons for Refusal for Japanese Application No. 2016-526765, dated May 15, 2018 with translation, 6 pages.

Non Final Office Action for U.S. Appl. No. 15/100,667, dated Sep. 12, 2016, 24 pages.

Cassens, et al. "Finishing and Maintaining Wood Floors", Wood Finishing, North Central Regional Extension Publication #136, pp. 1-8.

Berlin, et al. "Development of a Multipurpose Mobile Robot for Concrete Surface Processing", A Status Report, Feb. 1992, Sweden, pp. 1-10.

Caselli, et al. "Mobile Robot Navigation in Enclosed Large-Scale Space", Italy and U.S.A., pp. 1-5.

Larson, "RoboKent—a case study in man-machine interfaces" Industrial Robot, vol. 25 No. 2, 1998, pp. 95-100.

Doty, et al. "Sweep Strategies for a Sensory-Driven, Behavior-Based Vacuum Cleaning Agent", 1993, Machine Intelligence Laboratory-Gainesville Florida, AAAI 1993 Fall Symposium Series-Research Triangle Park—Raleigh, NC, Oct. 22-24, 1993, pp. 1-6.

Jones et al., Mobile Robots Inspiration to Implementation, Second Edition, A.K. Peters, Ltd., 1999, Chapters 1 and 5, 72pages.

Jones etal., Mobile Robots Inspiration to Implementation, Second Edition, A.K. Peters ,Ltd., 1999, Chapters 6 and 9, 56pages.

Everett, Sensors for Mobile Robots Theory and Application, A.K. Peters, 1995, Chapters 1 and 3, 70pages.

Everett, Sensors for Mobile Robots Theory and Application, A.K. Peters, Ltd., 1995, Chapters, 4a nd 5, 68pages.

Jones etal., Mobile Robots Inspiration to Implementation, Second Edition, A.K. Peters, Ltd., 1999, Chapters 10 and 11, 45pages.

Everett, Sensors for Mobile Robots Theory and Application, A.K. Peters, Ltd., 1995, Chapters 6, 7 and 10, 79pages.

Everett, Sensors for Mobile Robots Theory and Application, A.K. Peters, Ltd., 1995, Chapters 15 and 16, 59pages.

(56) References Cited

OTHER PUBLICATIONS

Notice of Allowance for U.S. Appl. No. 14/409,291, dated Jun. 16, 2016, 13 pages.
International Search Report and Written Opinion of the International Searching Authority for International Application No. PCT/Ep2012/077377, dated Nov. 6, 2014, 18 pages.
International Preliminary Report on Patentability for International Application No. PCT/EP2013/077377, dated Jun. 21, 2016, 12 pages.
International Search Report and Written Opinion of the International Searching Authority for International Application No. PCT/EP2013/077378, dated Apr. 9, 2014, 9 pages.
International Preliminary Report on Patentability for International Application No. PCT/EP2013/077378, dated Jun. 21, 2016, 7 pages.
International Search Report and Written Opinion of the International Searching Authority for International Application No. PCT/EP2013/077380, dated Jul. 28, 2014, 8 pages.
International Preliminary Report on Patentability for International Application No. PCT/EP203/077380, dated Jun. 21, 2016, 6 pages.
International Search Report and Written Opinion of the International Searching Authority for International Application No. PCT/EP2013/077384, dated Aug. 14, 2016, 9 pages.
International Preliminary Report on Patentability for International Application No. PCT/EP2013/077384, dated Jun. 21, 2016, 6 pages.
International Search Report and Written Opinion of the International Searching Authority for International Application No. PCT/EP2013/077385, dated May 27, 2015, 9 pages.
International Preliminary Report on Patentability for International Application No. PCT/EP2013/077385, dated Jun. 21, 2016, 7 pages.
International Search Report and Written Opinion of the International Searching Authority for International Application No. PCT/EP2013/077386, dated Sep. 17, 2014, 9 pages.
International Preliminary Report on Patentability for International Application No. PCT/EP2013/077386, dated Jun. 21, 2016, 6 pages.
International Search Report and Written Opinion of the International Searching Authority for International Application No. PCT/EP2013/077387, dated Sep. 30, 2014, 12 pages.
International Preliminary Report on Patentability for International Application No. PCT/EP2013/077387, dated Jun. 21, 2016, 9 pages.
International Search Report and Written Opinion of the International Searching Authority for International Application No. PCT/EP32013/077657, dated Aug. 18, 2014, 10 pages.
International Preliminary Report on Patentability for International Application No. PCT/EP2013/077657, dated Jun. 21, 2016, 7 pages.
International Search Report and Written Opinion of the International Searching Authority for International Application No. PCT/EP2013/077661, dated Jun. 10, 2014, 15 pages.
International Preliminary Report on Patentability for International Application No. PCT/EP2013/077661, dated Jun. 21, 2016, 11 pages.
Michael Carsten Bosse, "Atlas: A Framework for Large Scale Automated Mapping and Localization", Massachusetts Institute of Technology, Feb. 2004, Part 1, 140 pages.
Michael Carsten Bosse, "Atlas: A Framework for Large Scale Automated Mapping and Localization", Massachusetts Institute of Technology, Feb. 2004, Part 2, 67 pages.
International Search Report for International Application No. PCT/EP2013/067500 dated Dec. 10, 2013, 4pages.
Written Opinion for International Application No. PCT/EP2013/067500 dated Dec. 10, 2013, 7pages.
International Search Report for International Application No. PCT/EP2013/057814 dated Dec. 20, 2013, 5pages.
International Search Report for International Application No. PCT/EP2013/057815 dated Apr. 2, 2014, 4 pages.
Pack, et al., "Constructing a Wall-Follower Robot for a Senior Design Project", 1996 ASEE Annual Conference Proceedings, Session 1532, pp. 1-7.
Kube, "A Minimal Infrared Obstacle Detection Scheme", Department of Computing Science, University of Alberta, Edmonton, Alberta, Canada, The Robotics Practitioner, 2(2): 15-20, 1996, Oct. 23, 1998, pp. 1-8.
Gavrilut, et al., "Wall-Following Method for an Autonomous Mobile Robot using Two IR Sensors", 12th WSEAS International Conference on Systems, Heraklion, Greece, Jul. 22-24, 2008, ISBN: 978-960-6766-83-1, ISSN: 1790-2769, pp. 205-209.
Saffiotti, "Fuzzy logic in Autonomous Robot Navigation", a case study, Nov. 1995 Revised: Aug. 1997, IRIDIA, Universite Libre de Bruxelles, Belgium, , Technical Report TR/IRIDIA/ 95 25, Cover page + pp. 1-14.
Andersson, et al., "ISR: An Intelligent Service Robot", Centre for Autonomous Systems, Royal Institute of Technology, S-100 44 Stockholm, Sweden, pp. 1-24.
Yamamoto, "SOZZY: A Hormone-Driven Autonomous Vacuum Cleaner", From: AAAI Technical Report FS-93-03, Matasushita Research Institute, Tokyo, and MIT Artificial Intelligence laboratory, Massachusetts, pp. 116-124 + Figure 9 and Figure 11.
Jenkins, "Practical Requirements for a Domestic Vacuum-Cleaning Robot", From: AAAI Technical Report FS-93-03., JRL Consulting, Menlo Park, California, pp. 85-90.
Collins, et al. "Cerebellar Control of a Line Following Robot", Computer Science and Electrical Engineering Department, University of Queensland, St.Lucia, Queensland, 4072 A, pp. 1-6.
"SM51 Series Opposed Mode Sensors, Dc sensors with metal housings: SM51EB/Rb, SM51EB6/RB6", Banner Engineering Corporation, pp. 1-24.
Everett, et al. "Survey of Collision Avoidance and Ranging Sensors for Mobile Robots", Revision 1, Technical Report 1194, Dec. 1992, pp. 1-154.
LeBouthillier, "W. Grey Walter and his Turtle Robots", The Robot Builder, vol. Eleven No. Five, May 1999, RSSC POB 26044, Santa Ana,CA, pp. 1-8.
Herbst, et al., "Micromouse Design Specifications", Jun. 2, 1998, pp. 1-22.
Oren, Reply to Office Action dated Jun. 23, 2014, U.S. Appl. No. 13/757,985, pp. 1-10.
Maaref,etal."Sensor-based navigation of a mobile robot in an indoor environment", Robotics and Autonomous Systems, 2002, Elsevier, 18pages.
Braunstingl, et al., "Fuzzy, Logic Wall Following of a Mobile Robot Based on the Concept of General Perception", ICAR '95, 7th International Conference on Advanced Robotics, Sant Feliu De Guixols, Spain pp. 367-376., Sep. 1995, pp. 1-9.
Krishna, et al., "Solving the Local Minima Problem for a Mobile Robot by Classification of Spatio-Temporal Sensory Sequences", Journal of Robotic Systems 17 (10), 2000, pp. 549-564.
Borenstein, et al. "Real-Time Obstacle Avoidance for Fast Mobile Robots", IEEE, Jan. 6, 1996, pp. 1-18.
Jung, et al. "Whisker Based Mobile Robot Navigation", Wollongong, NSW 2500, Australia, pp. 1-8.
International Search Report and Written Opinion of the International Searching Authority for International Application No. PCT/EP2014/078144, 7 pages.
International Search Report and Written Opinion of the International Searching Authority for International Application No. PCT/EP2014/069073, dated May 12, 2015, 10pages.
Non Final Office Action for U.S. Appl. No. 14/409,291, dated Dec. 28, 2016, 61pages.
Non Final Office Action for U.S. Appl. No. 15/101,257, dated Feb. 10, 2017, 10 pages.
Extended European Search Report for European Application No. 16176479.0, dated Nov. 11, 2016, 9pages.
International Search Report and Written Opinion of the International Searching Authority for International Application No. PCT/EP2014/069074, dated May 11, 2015, 9 pages.
Japanese Office Action for Japanese Application No. 2016-506795 , dated Feb. 7, 2017 with translation, 6 pages.
Chinese Office Action for Chinese Application No. 20130075510.9, dated Feb. 6, 2017 with translation, 14pages.
Japanese Office Action for Japanese Application No. 2016-506794, dated Feb. 7, 2017 with translation, 10 pages.

(56) References Cited

OTHER PUBLICATIONS

Chinese Office Action for Chinese Application No. 201380075503.9, dated Feb. 13, 2017 with translation, 18 pages.
International Search Report and Written Opinion of the International Searching Authority for International Application No. PCT/EP2014/077549, dated Jul. 27, 2015, 9 pages.
International Search Report and Written Opinion of the International Searching Authority for International Application No. PCT/EP2014/077947, dated Jul. 11, 2016, 14 pages.
International Search Report and Written Opinion of the International Searching Authority for International Application No. PCT/EP2014/077954, dated Oct. 12, 2015, 19pages.
International Search Report and Written Opinion of the International Searching Authority fo rInternatonal Applicaion No. PCT/EP2014/0077142, dated Sep. 11, 2015, 8 pages.
Chung etal.,"Path Planning for a Mobile Robot With Grid Type World Model", Proceedings of the 1992 IEEE/RSJ International Conference on Intelligent Robots and Systems,Jul. 7-10, 1992, pp. 439-444.
Non Final Office Action for U.S. Appl. No. 15/101,235 dated Apr. 21, 2017, 10 pages.
Final Office Action for U.S. Appl. No. 15/100,667, dated Apr. 21, 2017, 26 pages.
Non Final Office Action for U.S. Appl. No. 15/101,212, dated May 17, 2017, 8 pages.
Japanese Office Action for Application for Japanese Application No. 2015-528969, dated Apr. 7, 2017 with translation, 4 pages.
Final Office Action for U.S. Appl. No. 14/409,291, dated Jun. 6, 2017, 21 pages.
International Search Report and Written Opinion of the International Searching Authority for *International Application No. PCT/EP2015/058377, dated Aug. 10, 2016, 15 pages.
Notice of Allowance for U.S. Appl. No. 15/101,257, dated Jul. 6, 2017, 9 pages.
Non Final Office Action for U.S. Appl. No. 15/102,015, dated Aug. 17, 2017, 13 pages.
Chinese Office Action for Chinese Application No. 201380075503.9, dated Nov. 8, 2017 with translation, 16 pages.
European Communication Pursuant to Article 94(3) for European Application No. 16176479.0, dated Nov. 27, 2017, 6 pages.
International Search Report and Written Opinion for International Application No. PCT/EP2015/070140, dated May 27, 2016, 11 pages.
European Communication Pursuant to Article 94(3) for European Application No. 13817911.4, dated Jan. 15, 2018, 8 pages.
Non Final Office Action for U.S. Appl. No. 15/102,017, dated Feb. 16, 2018, 12 pages.
Non Final Office Action for U.S. Appl. No. 15/101,235, dated Nov. 1, 2017, 11 pages.
Non Final Office Action for U.S. Appl. No. 15/100,667, dated Nov. 29, 2017, 22 pages.
Non Final Office Action for U.S. Appl. No. 14/784,106, dated Oct. 19, 2017, 11 pages.
Final Office Action for U.S. Appl. No. 15/101,212, dated Oct. 11, 2017, 7 pages.
Chinese Office Action for Chinese Application No. 201380075510.9, dated Oct. 27, 2017 with translation, 13 pages.
Notification of Reasons for Refusal for Japanese Application No. 2016-526945, dated Oct. 31, 2017 with translation, 8 pages.
Notification of Reasons for Refusal for Japanese Application No. 2016-526875, dated Oct. 31, 2017 with translation, 10 pages.
Notice of Reasons for Rejection for Japanese Application No. 2016-526947, dated Sep. 21, 2017 with translation, 8 pages.
Notice of Allowance for U.S. Appl. No. 15/102,015, dated Dec. 11, 2017, 8 pages.
International Search Report and Written Opinion for International Application No. PCT/EP2016/055547, dated Jan. 2, 2017, 10 pages.
Notice of Allowance for U.S. Appl. No. 15/100,667,dated Aug. 6, 2018, 10 pages.
Non Final Office Action for U.S. Appl. No. 15/101,510, dated Jul. 27, 2018, 17 pages.
Non Final Office Action for U.S. Appl. No. 14/784,110, dated Aug. 16, 2018, 13 pages.
Chinese Office Action for Chinese Application No. 201380081537.9, dated Jun. 4, 2018 with translation, 15 pages.
Notice of Allowance for U.S. Appl. No. 15/101,510, dated May 30, 2019, 12 pages.
Notice of Allowance for U.S. Appl. No. 14/784,106, dated Oct. 11, 2018, 7 pages.
Non Final Office Action for U.S. Appl. No. 15/321,333, dated Oct. 24, 2018, 10 pages.
Position_ Definition of Position by Merriam-Webster.pdf (Position | Definition of Position by Merriam-Webster, Oct. 16, 2018, Merriam-Webster, https://www.merriam-webster.com/dictionary/position, pp. 1-15.
Gutman et al., AMOS: Comparison of Scan Matching Approaches for Self-Localization in Indoor Environments, 1996, IEEE, pp. 61-67.
Non Final Office Action for U.S. Appl. No. 15/504,071, dated Nov. 2, 2018, 17 pages.
Notification of Reasons for Refusal of Japanese Application No. 2016-568949, dated Oct. 1, 2018 with translation, 6 pages.
Non Final Office Action for U.S. Appl. No. 15/504,066, dated Nov. 5, 2018, 18 pages.
Non Final Office Action for U.S. Appl. No. 15/101,515, dated Apr. 18, 2018, 14 pages.
Notice of Allowance for U.S. Appl. No. 15/101,212, dated Apr. 11, 2018, 9 pages.
Final Office Action for U.S. Appl. No. 14/784,106, dated Mar. 28, 2018, 8 pages.
Final Office Action for U.S. Appl. No. 15/100,667, dated Mar. 27, 2018, 22 pages.
Notification of Reasons for Refusal for Japanese Application No. 2017-501374, dated Mar. 6, 2018 with translation, 8 pages.
Chinese Office Action for Chinese Application No. 201380081535.X, dated Mar. 26, 2018 with translation, 18 pages.
Chinese Office Action for Chinese Application No. 201380081103.9, dated Feb. 27, 2018 with translation, 19 pages.
International Search Report and Written Opinion of the International Searching Authority for International Application No. PCT/E2016/072291, dated Jun. 6, 2017, 11 pages.
Non Final Office Action for U.S. Appl. No. 15/102,017, dated Jan. 22, 2019, 15 pages.
Final Office Action for U.S. Appl. No. 15/101,510, dated Feb. 8, 2019, 16 pages.
Chinese Office Action for Chinese Application No. 201380081103.9, dated Jun. 6, 2019 with translation, 10 pages.
Extended European Search Report for European Application No. 18157403.9, dated Nov. 14, 2018, 12 pages.
Report of Reconsideration by Examiner before Appeal for Japanese Application No. 2016-526875, dated Oct. 24, 2018, 2 pages.
Final Office Action for U.S. Appl. No. 15/101,235, dated Jan. 11, 2019, 12 pages.
Final Office Action for U.S. Appl. No. 15/504,071, dated Mar. 5, 2019, 20 pages.
Final Office Action for U.S. Appl. No. 15/504,066, dated Mar. 21, 2019, 18 pages.
Non Final Office Action for U.S. Appl. No. 15/504,071, dated Aug. 8, 2019, 23 pages.
Notice of Allowance for U.S. Appl. No. 15/504,066, dated Aug. 9, 2019, 8 pages.
Final Office Action for U.S. Appl. No. 15/504,071, dated Dec. 4, 2019, 20 pages.
Chinese Office Action for Chinese Application No. 201480083392.0, dated Jan. 3, 2020, 8 pages.
Notice of Allowance for U.S. Appl. No. 15/504,071, dated Mar. 23, 2020, 11 pages.

* cited by examiner

SIDE BRUSH AND ROBOTIC CLEANER

This application is a U.S. National Phase application of PCT International Application No. PCT/EP2014/077549, filed Dec. 12, 2014, which is incorporated by reference herein.

TECHNICAL FIELD

The present invention relates to a side brush for a robotic cleaner, such as a robotic vacuum cleaner. The present invention further relates to a robotic cleaner, such as a robotic vacuum cleaner.

BACKGROUND

A robotic vacuum cleaner forms a self-propelling unit provided with a drive arrangement comprising a control system configured to control a movement of the robotic vacuum cleaner along a surface to be cleaned. The control system may comprise one or more sensors providing input to assist in controlling the movement of the robotic vacuum cleaner. A suction producing unit of the robotic vacuum cleaner is arranged in fluid communication with an opening of a nozzle inlet facing the surface to be cleaned. Dust and debris sucked or otherwise propelled into the opening is directed into a debris receptacle of the robotic vacuum cleaner. The debris receptacle is emptied, or replaced, when filled with dust and debris to a certain degree.

Robotic cleaners, such as robotic vacuum cleaners, configured to travel along a surface to be cleaned may be provided with so called side brushes. A side brush is rotatable about a substantially vertical axis and comprises bristles extending outwardly from the rotation axis. The side brush may sweep dust and debris from beside, and/or a side portion of, the robotic cleaner to underneath the robotic cleaner for further transportation into a debris receptacle inside the robotic cleaner. The side brush may be arranged to reach into narrow corners and crevices where an elongated brush roll underneath the robotic cleaner and/or the suction produced in the robotic cleaner does not reach.

The side brush comprises a number of bristles. As the side brush rotates and the robotic cleaner travels towards an obstacle in the form of e.g. a carpet edge or a cable, one or more of the bristles may project underneath the obstacle. If the robotic cleaner continues to travel towards the obstacle, the one or more bristles may be caught underneath the obstacle. The one or more bristles may fold and the side brush may entangle with the obstacle. In worst case, the robotic cleaner may be prevented from continuing travelling along the surface to be cleaned, or the robotic cleaner may drag the obstacle with it along the floor resulting in potential furniture damage, as the robotic cleaner may be difficult to control.

It is known to provide the side brush with few bristles and/or long bristles to reduce this problem. However, both these solutions provide a poor cleaning result with the side brush. A further way of reducing this problem is to provide the bristles in bunches, each bunch being connected to a central portion of the side brush by means of tubular portion, which bundles the bristles of each bunch. That is, the bristles do not extend freely directly from the central portion, but extend instead freely from the tubular portion at a distance from the central portion. Also this solution provides a poor cleaning result since the bristles will be bundled in distinct bunches thinly distributed around the side brush.

SUMMARY

It is an object of the present invention to provide an alternative side brush, which does not entangle easily underneath an obstacle as a related robotic cleaner travels towards the obstacle.

According to an aspect of the invention, the object is achieved by a side brush for a robotic cleaner, the side brush being rotatable about a rotation axis in a rotational direction and comprising a brush body and numerous linear bristles including a first bristle having a base end at the brush body and an opposite distal end. The numerous bristles extend freely from the brush body to their respective distal ends. The rotation axis extends centrally through the brush body and an imaginary line extends perpendicularly to the rotation axis. The first bristle is arranged with its base end at a distance from the rotation axis on the imaginary line extending in a bristle direction outwardly from the brush body. Seen in a top view, along the rotation axis, the bristle direction extends at a first angle to the imaginary line with the distal end pointing rearwardly in relation to the rotational direction. Seen in a side view, along the imaginary line, the bristle direction extends at a second acute angle to the rotation axis pointing away from the brush body.

Due to the first bristle of the side brush being directed both in a rearward direction in relation to the rotational direction of the side brush and a downward direction during use of the side brush, if the distal end of the first bristle is pushed underneath an obstacle such as a carpet or a cable, the base end of the first bristle closest to the brush body will be angled such that upon further rotation of the side brush, the first bristle will be biased upwardly over the obstacle. Accordingly, the first bristle and will not entangle with the obstacle. As a result, the above mentioned object is achieved. Moreover, in a side brush having all its numerous bristles arranged in a same manner as the first bristle, the numerous bristles may be arranged more densely than in a side brush with bristles extending radially from the brush body, while still preventing the side brush from entangling with an obstacle.

Herein, a linear bristle refers to a bristle which is straight in an unloaded state, i.e. when the bristle of the brush does not abut against any surface to be cleaned. When mounted in a robotic cleaner, the bristle will abut against a surface to be cleaned. Suitably the bristle will be curved to a certain extent when it abuts against the surface to be cleaned. Thus, the bristle will be biased with a force towards the surface to be cleaned. The imaginary line extending perpendicularly to the rotation axis may entail that the imaginary line extends substantially horizontally in use of the side brush in a robotic cleaner. The brush body forms a central portion of the side brush. The brush body may comprise an interface configured for connection to a rotation axle of a relevant robotic cleaner. The side brush may be removably secured to the robotic cleaner.

The bristles may be arranged in discrete bunches of bristles. In such embodiments the maximum distance between the bristles of the side brush may be between one bristle of a first bunches of bristles and a further bristle of an adjacent bunch of bristles. Alternatively, the bristles may be arranged in one or more continuous lines in a circular direction around the brush body. In such embodiments all bristles may even be arranged one bristle abutting against at least one further bristle all around the brush body.

According to embodiments, the numerous bristles may be similarly arranged around the brush body as the first bristle. In this manner the numerous bristles of the side brush may extend rearwardly and downwardly to form, in an unloaded state, a substantially frustoconical brim of bristles.

According to a further aspect of the present invention, the above-mentioned object is achieved by a robotic cleaner. The robotic cleaner comprises a housing, a drive arrangement being configured to drive the robotic cleaner along a surface to be cleaned, a debris receptacle arranged inside the housing, a nozzle inlet in the housing facing the surface to be cleaned, and a side brush comprising bristles configured to abut against the surface to be cleaned. The side brush is rotatable about a substantially vertical rotation axis. The side brush is a side brush according to any aspect and/or embodiment discussed herein.

The robotic cleaner may be a self-propelling unit. The robotic cleaner may be a robotic vacuum cleaner, which comprises a suction producing unit. The side brush may sweep dust and debris from beside, and/or a side portion of, the robotic cleaner to underneath the robotic cleaner towards, or into, the nozzle inlet for further transportation into the debris receptacle inside the robotic cleaner. The side brush may be arranged to reach into narrow corners and crevices where an elongated brush roll underneath the robotic cleaner and/or suction produced in the robotic cleaner does not reach.

According to embodiments, the side brush may be arranged at a peripheral portion of the housing, which peripheral portion faces the surface to be cleaned. In this manner the side brush may reach laterally at least to an outer periphery of the housing to propel dust and debris towards the nozzle inlet in the housing.

According to embodiments, the housing may comprise a bottom surface in, or at, the peripheral portion. The bottom surface may be provided with a recess. The brush body of the side brush may be arranged in the recess at a depth such that the base end of the first bristle is positioned within the recess and during use of the robotic cleaner the base end is arranged above the bottom surface. In this manner, if the first bristle should slide underneath an obstacle such as a carpet or a cable, the obstacle may follow along the first bristle only to the bottom surface of the housing, but may not reach the base end of the first bristle. Thus, the obstacle is prevented from entangling with the bristles of the side brush. Naturally, the side brush may be arranged in the recess such that the base ends of all the numerous bristles of the side brush are positioned within the recess.

According to embodiments, the numerous bristles may have a curved shape during use of the robotic cleaner. The curved shape may be due to the initially straight bristles abutting against the surface to be cleaned.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1A:
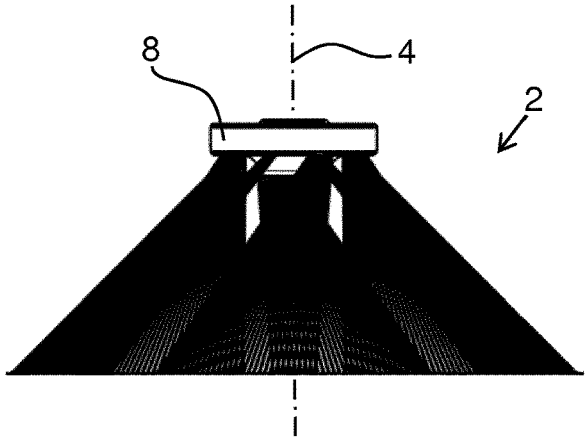
FIGS. 1*a*-1*c* illustrate schematically various views of a side brush according to embodiments.
Figure 1B:
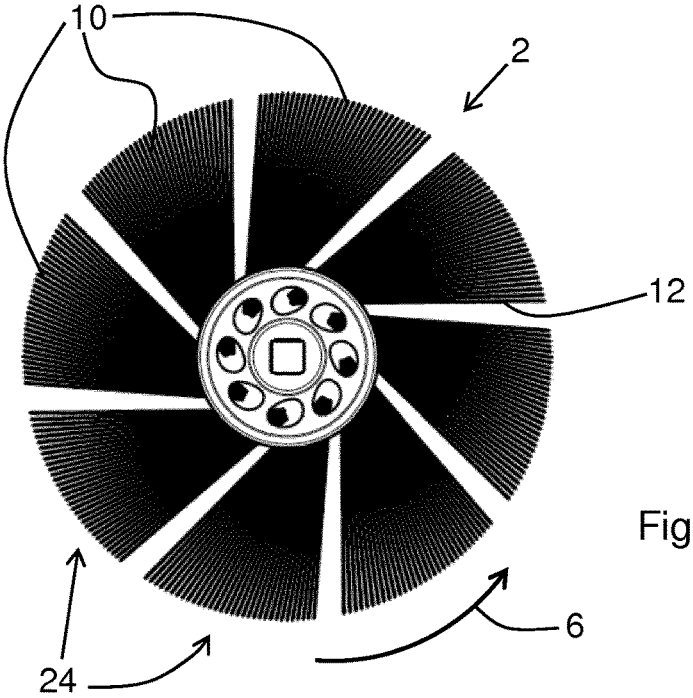
Figure 1C:
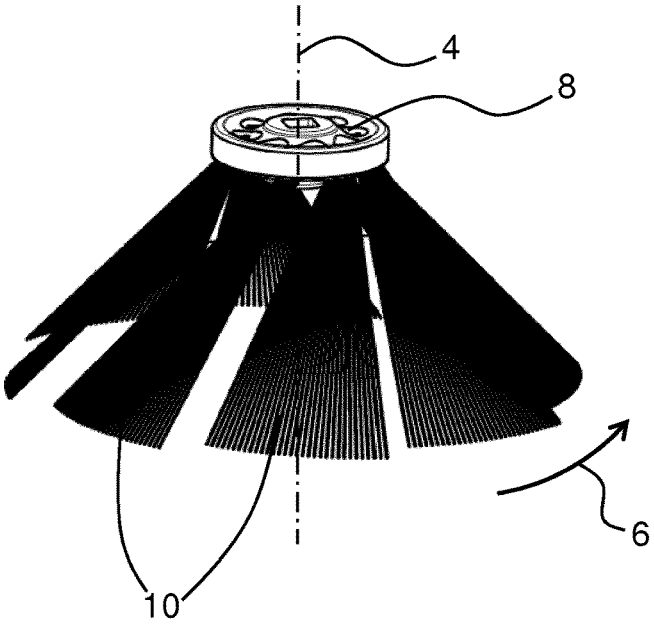
Figure 2A:
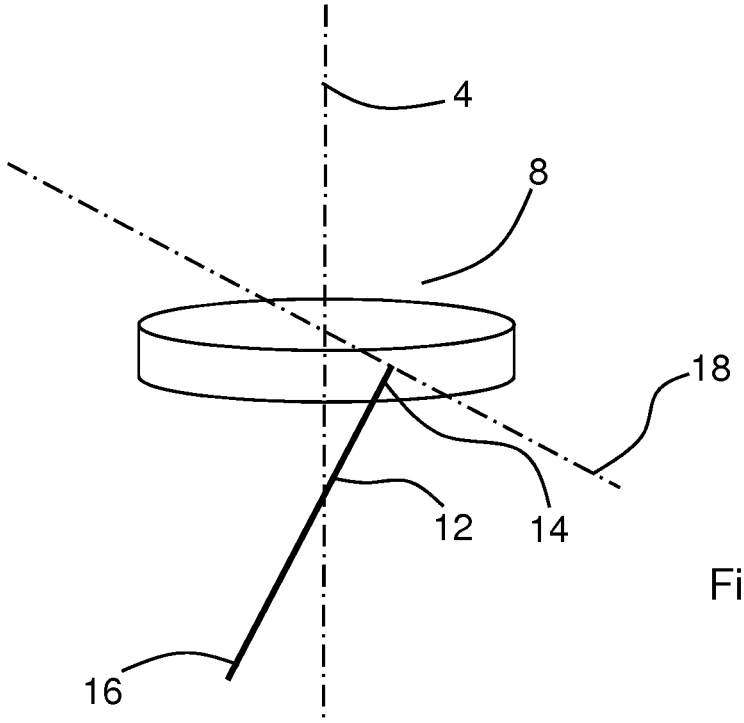
FIGS. 2*a*-2*c* illustrate schematically a brush body and a first bristle of the side brush illustrated in FIGS. 1*a*-1*c*, FIGS. 3*a*-3*c* illustrate various views of the side brush of FIGS. 1*a*-1*c* in a loaded state.
Figure 2B:
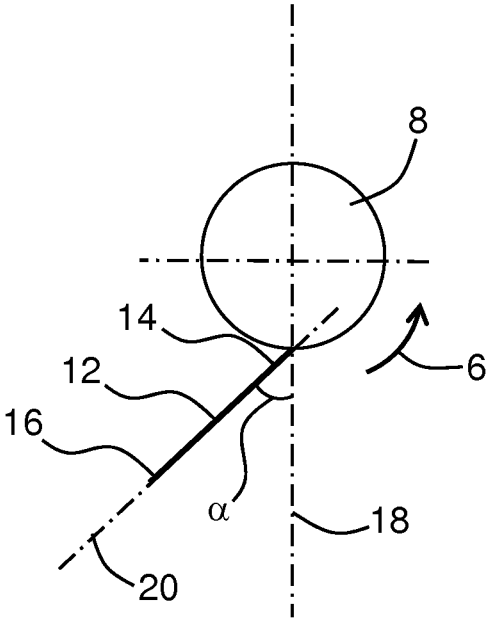
Figure 2C:
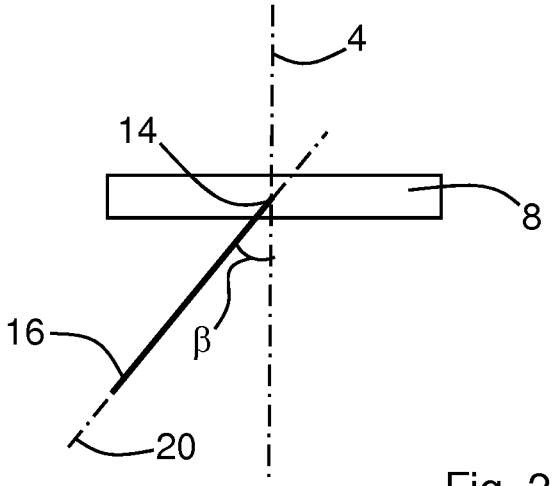

FIGS. 1*a*-1*c* illustrate schematically various views of a side brush 2 according to embodiments. The side brush 2 is configured for use with a robotic cleaner, such as a robotic vacuum cleaner. The side brush 2 is rotatable about a rotation axis 4 in a rotational direction 6, indicated with an arrow. The side brush 2 comprises a brush body 8 and numerous linear bristles 10 including a first bristle 12. The rotation axis 4 extends centrally through the brush body 8. Each of the numerous bristles 10 has a base end at the brush body 8 and a distal end. The numerous bristles 10 extend freely from the brush body 8 to their respective distal ends, corresponding to the distal end of the first bristle 12. In FIGS. 1*a*-1*c* the side brush 2 is illustrated in an unloaded state, i.e. when side brush 2 is handled as a separate part and it is not mounted in a relevant robotic cleaner FIGS. 2*a*-2*c* illustrate schematically the brush body 8 and the first bristle 12 of the side brush 2 illustrated in FIGS. 1*a*-1*c*. The remaining bristles have been omitted for the sake of clarity. The first bristle 12 has a base end 14 at the brush body 8 and an opposite distal end 16. An imaginary line 18 extends perpendicularly to the rotation axis 4, see FIGS. 2*a*, 2*b*. The first bristle 12 is arranged with its base end 14 at a distance from the rotation axis 4 on the imaginary line 18, see FIG. 2*b*. The first bristle 12 extends in a bristle direction 20 outwardly from the brush body 8. Seen in the top view of FIG. 2*b*, i.e. along the rotation axis 4, the bristle direction 20 extends at a first angle $\alpha$ to the imaginary line 18 with the distal end 16 pointing rearwardly in relation to the rotational direction 6. Seen in the side view of FIG. 2*c*, along the imaginary line 18, the bristle direction 20 extends at a second acute angle $\beta$ to the rotation axis 4. Thus, the first bristle 12 points away from the brush body 8. Accordingly, seen in the rotational direction 6, the base end 14 travels ahead of the distal end 16.

Returning to FIGS. 1*a*-1*c*, each of the numerous bristles 10 are similarly arranged around the brush body 8 as the first bristle 12. Depending on the attachment arrangement of the bristles to the brush body 8, the first angle $\alpha$ and second acute angle ß of each bristle may vary by a few degrees. However, all the numerous bristles of the side brush 2 extend rearwardly and downwardly from the brush body, such that seen in the rotational direction 6, the respective base ends of the numerous bristles 10 travel ahead of the respective distal ends of the numerous bristles 10 as the side brush 2 rotates in the rotational direction 6.

In these embodiments the first angle $\alpha$ is approximately 50 degrees. According to alternative embodiments, the first angle $\alpha$ may be within a range of 30-90 degrees to the imaginary line 18. According to preferred embodiments, the first angle $\alpha$ may be within a range of 45-90 degrees.

In these embodiments the second acute angle $\beta$ is approximately 40 degrees. According to alternative embodiments, the second acute angle $\beta$ may be within a range of 1-85 degrees to the rotation axis 4. According to preferred embodiments, the second acute angle $\beta$ may be within a range of 30-75 degrees.

Each of the numerous bristles 10 may have a diameter within a range of 0.05-0.3 mm, preferably within a range of 0.1-0.2 mm.

Each of the numerous bristles 10 may have a length within a range of 15-200 mm, preferably within a range of 40-70 mm.

The numerous bristles 10 may comprise bristles made from natural fibres, e.g. horsehair, and/or bristles made from synthetic material, e.g. Polybutylene terephthalate (PBT), or nylon.

A diameter of the side brush 2 may be within a range of 40-200 mm, preferably within a range of 80-160 mm. The diameter is that of an unloaded side brush 2, as illustrated in FIGS. 1*a*-1*c*.

According to embodiments, the side brush 2 may have a mean bristle density of at least 3 bristles/degree with a maximum distance between at least two of the numerous bristles 10 of 30 degrees. In this manner a dense side brush 2 may be provided, which renders a thorough cleaning result. Due to the above discussed first angle $\alpha$ and second acute angle $\beta$, even with a side brush 2 having such densely arranged bristles, the entangling with objects may be avoided.

In these embodiments the numerous bristles 10 are arranged in eight bunches 24 of bristles around the bristle body 8. According to alternative embodiments, the numerous bristles 10 may be arranged in at least eight bunches 24 of bristles around the brush body 8.

In a side brush having the bristles arranged in bunches of bristles, locally the bristle density may be considerably higher than the above-discussed 3 bristles/degree. However, the mean bristle density over the entire circumference suitably may be at least 3 bristles/degree.

According to embodiments, each of the at least eight bunches 24 of bristles may comprise at least 150 bristles. In this manner the above mentioned mean bristle density may be achieved.

According to embodiments, the brush body 8 may be substantially circular with a diameter within a range of 15-70 mm, preferably within a range of 20-50 mm.

Figure 3A:
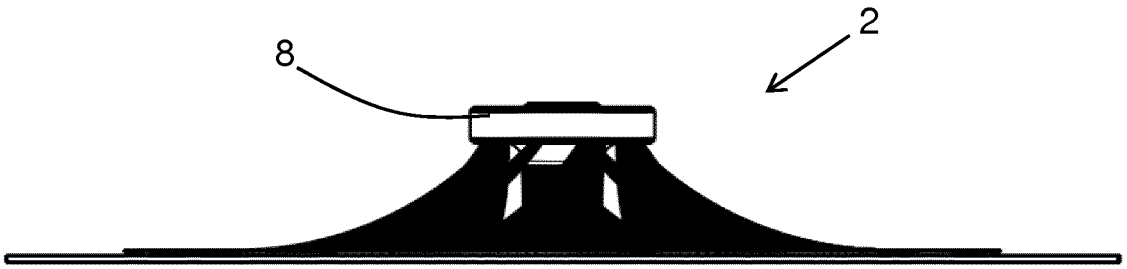
Figure 3B:
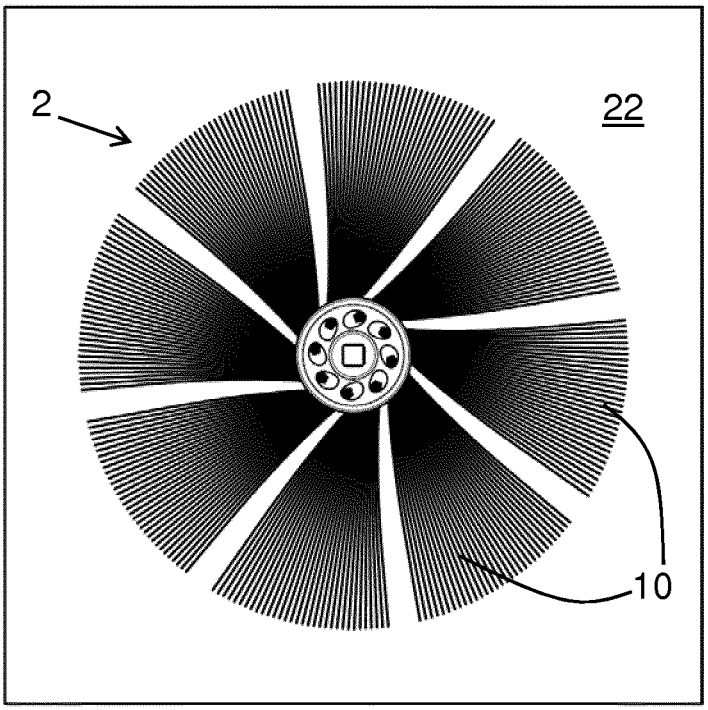
Figure 3C:
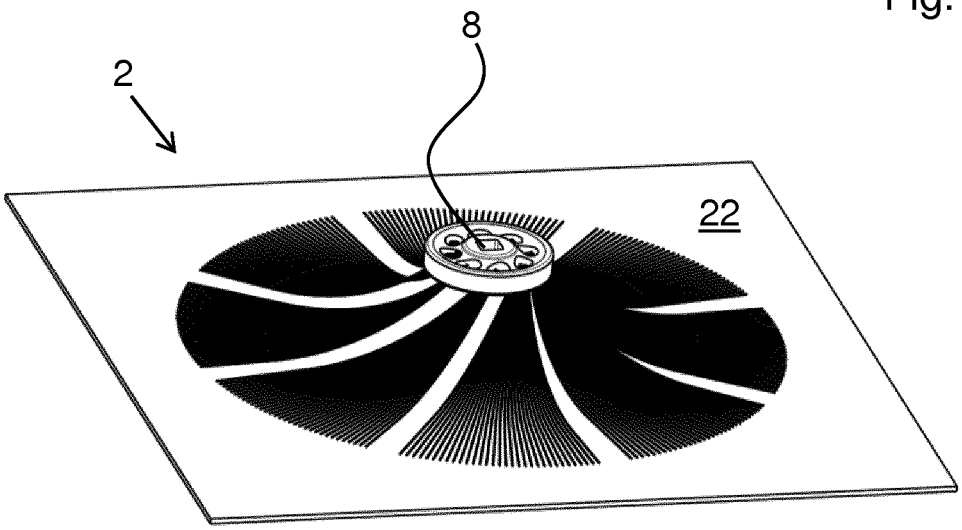

FIGS. 3*a*-3*c* illustrate various views of the side brush 2 of FIGS. 1*a*-1*c* in a loaded state, i.e. as when the side brush 2 is mounted in a robotic cleaner and abuts against a surface 22 to be cleaned. The numerous bristles 10 adapt a curved shape when at least some of them abut against the surface 22 to be cleaned. Thus, the numerous bristles 10 will be biased with a force towards the surface 22 to be cleaned. The biasing force depends inter alia on the height the brush body 8 in a housing of a relevant robotic cleaner above the surface 22 to be cleaned, the length of the numerous bristles 10, and the stiffness of the numerous bristles 10.

Figure 4A:
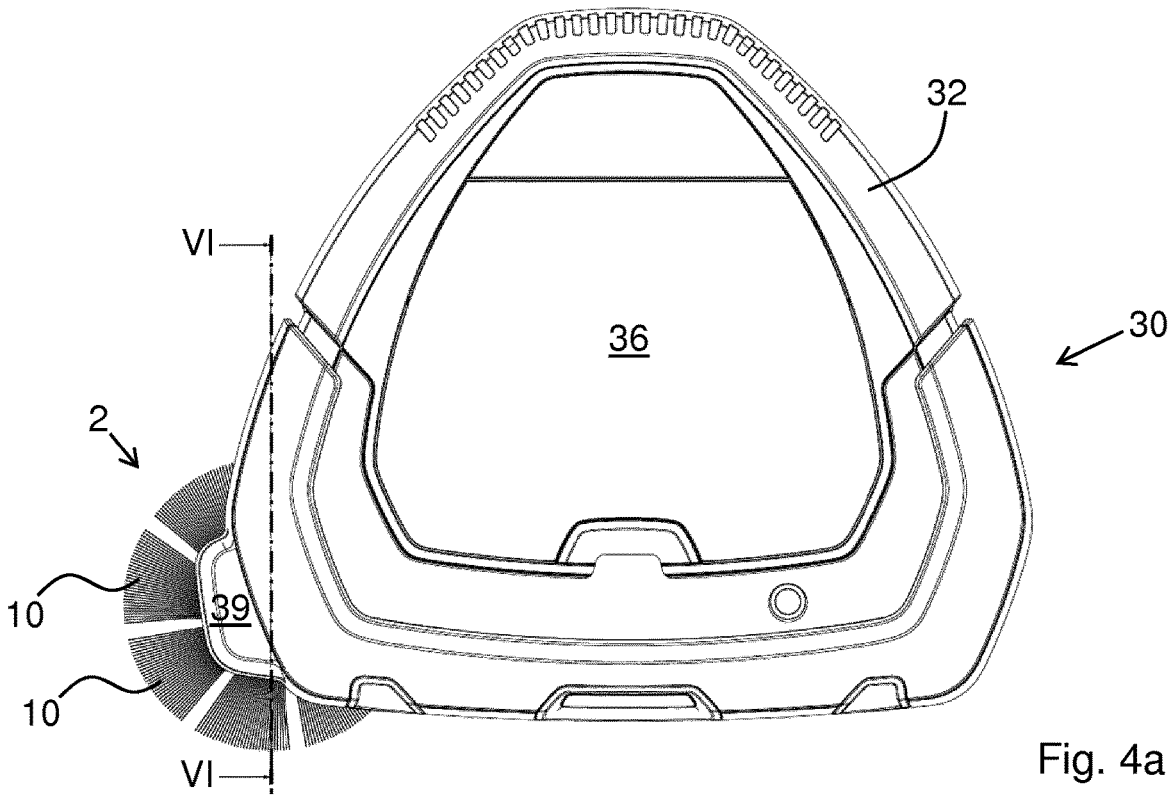
FIGS. 4*a* and 4*b* illustrate a top view and a bottom view of a robotic cleaner according to embodiments.
Figure 4B:
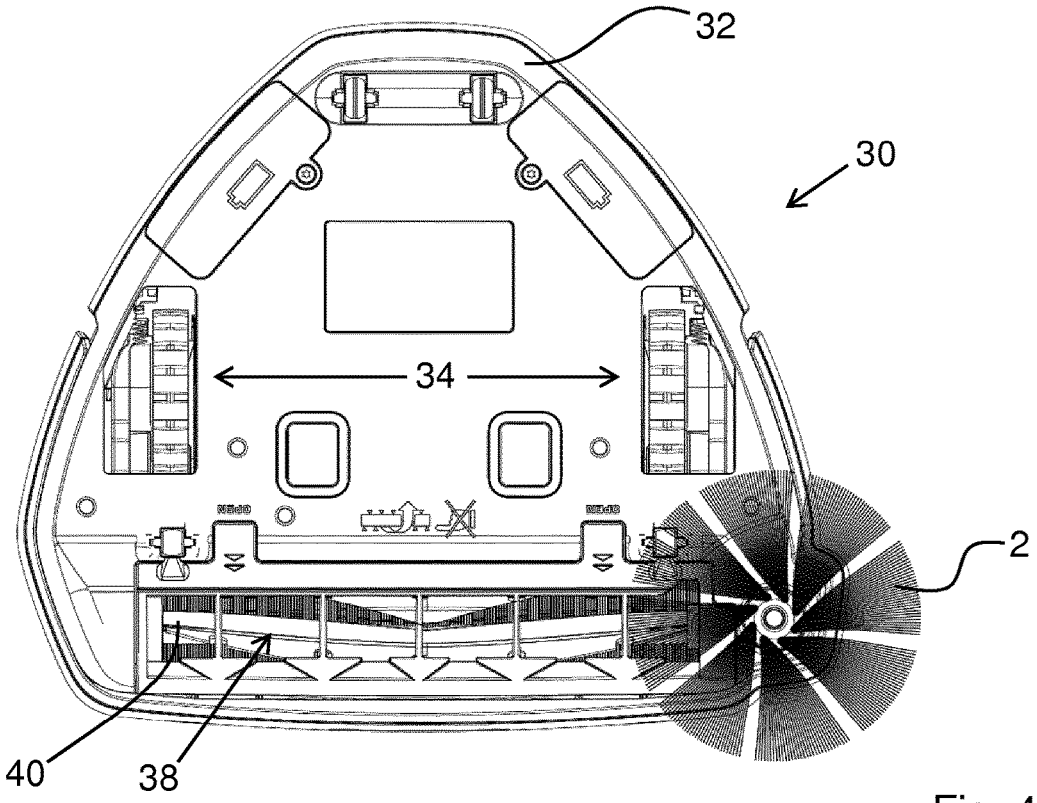

FIGS. 4*a* and 4*b* illustrate a top view and a bottom view of a robotic cleaner 30 according to embodiments. The robotic cleaner 30 comprises a housing 32, a drive arrangement 34 being configured to drive the robotic cleaner 30 along the surface to be cleaned, a debris receptacle 36 arranged inside the housing 32, a nozzle inlet 38 in the housing 32 facing the surface to be cleaned, and a side brush 2 according to any aspect and/or embodiment discussed herein.

The robotic cleaner 30 is a self-propelling unit. The drive arrangement 34 comprises four wheels, of which at least one wheel is directly or indirectly driven by an electric drive motor arranged inside the housing 32. The drive arrangement 34 further comprises a control system configured to control the electric drive motor to move the robotic cleaner 30 about the surface to be cleaned. The control system may comprise one or more sensors to provide input assisting in controlling the movement of the robotic cleaner 30. The at least one sensor may be of one or more different kinds, such as e.g. an infrared sensor, a laser sensor, an ultrasonic sensor, or a contact sensor.

The nozzle inlet 38 communicates with the debris receptacle 36 such that dust and debris may be transported from the nozzle inlet 38 into the debris receptacle 36. A rotating brush roll 40 arranged inside the housing at the nozzle inlet 38, and having a rotation axis extending substantially in parallel with the surface to be cleaned, may assist in propelling dust and debris into the debris receptacle 36. The side brush 2 is configured to transport dust and debris towards the nozzle inlet 38. The side brush 2 and the brush roll 40 may be driven by one or more electric brush motors. Besides controlling the drive motor, the control system may also control the one or more brush motors.

The debris receptacle 36 may be removable to be emptied. The debris receptacle 36 may comprise a disposable bag, inside which dust and debris are collected.

The robotic cleaner 30 is a robotic vacuum cleaner, which comprises a suction producing unit. The suction producing unit may comprise a fan driven by an electric fan motor. The control system may also control the fan motor. The nozzle inlet 38 is arranged in fluid communication with the debris receptacle via a debris conduit system. The suction producing unit is arranged in fluid communication with the nozzle inlet 38 via the debris conduit system and optionally also via the debris receptacle 36, i.e. the vacuum producing unit in some embodiments may create a suction from the nozzle inlet 38 via the debris conduit system to the debris receptacle 36. The robotic cleaner 30 comprises one or more rechargeable batteries configured to power the drive arrangement 34 including the control system and the various electric motors.

The side brush 2 is arranged at a peripheral portion 39 of the housing 32, which peripheral portion 39 faces the surface to be cleaned. In these embodiments the numerous bristles 10 extend beyond the housing 32, seen in the top view of FIG. 4*a*. In alternative embodiments, the numerous bristles may not reach beyond the housing, seen in a top view, but may extend only to an edge of the housing.

Figure 5:
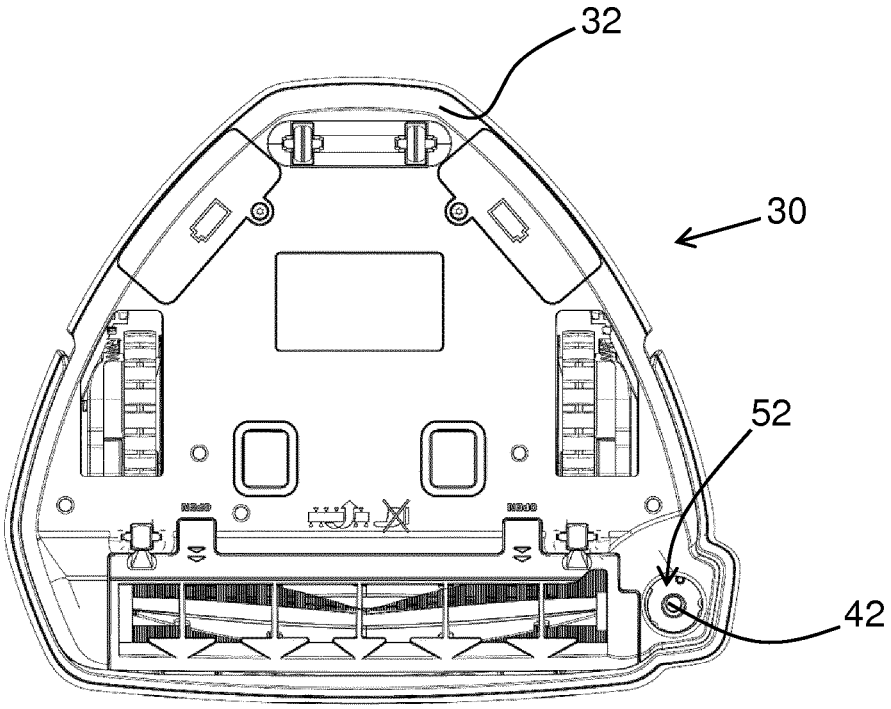
FIG. 5 illustrates a bottom view of the robotic cleaner of FIGS. 4*a* and 4*b* with a side brush removed.

FIG. 5 illustrates a bottom view of the robotic cleaner 30 of FIGS. 4*a* and 4*b* with the side brush removed. A drive shaft 42 for the side brush protrudes from the housing 32.

Figure 6:
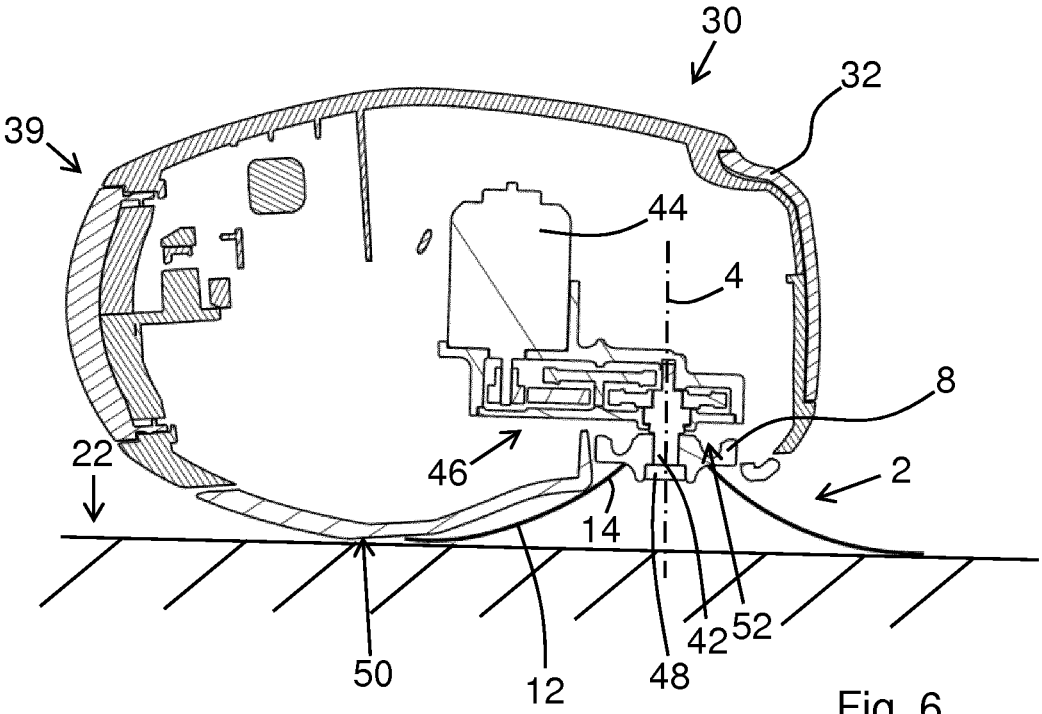
FIG. 6 illustrates a cross section of the robotic cleaner of FIGS. 4*a* and 4*b*.

FIG. 6 illustrates a cross section of the robotic cleaner 30 along line VI-VI in FIG. 4*a*. The first bristle 12 and a further bristle of the side brush 2 are schematically illustrated, abutting against a surface 22 to be cleaned. The remaining bristles have been omitted for the sake of clarity. Due to at least some of the bristles abutting against the surface 22 to be cleaned, the bristles have a curved shape during use of the robotic cleaner 30, when it travels along the surface 22 to be cleaned.

The side brush 2 is rotatable about its substantially vertically extending rotation axis 4 by an electric brush motor 44. The brush motor 44 is connected to a transmission 46 comprising the drive shaft 42. The side brush 2 is connected to the drive shaft 42.

Suitably, the brush body 8 of the side brush 2 comprises an interface configured for connection to the drive shaft 42. The interface may e.g. comprise an opening for receiving an end of the drive shaft 42. If the drive shaft 42 is made from a magnetic material, a magnet member 48 may be arranged in the brush body 8 to ensure that the side brush 2 is removably secured to the drive shaft 42 and the robotic cleaner 30. Thus, the side brush 2 may be easily removed for cleaning or to be replaced.

According to embodiments, the housing 32 comprises a bottom surface 50 in, or at, the peripheral portion 39. The bottom surface 50 is provided with a recess 52. The drive shaft 42 extends into the recess 52, see also FIG. 5. The brush body 8 of the side brush 2 is arranged in the recess 52, attached to the drive shaft 42, at a depth such that the base end 14 of the first bristle 12 is positioned within the recess 52.

During use of the robotic cleaner 30, the base end 14 is arranged above the bottom surface 50, i.e. higher above the surface 22 to be cleaned than the bottom surface 50. Accordingly, if the first bristle 12 should slide underneath an obstacle, such as a carpet or a cable, the obstacle may follow along the first bristle 12 upwardly only to the bottom surface 50, but may not reach the base end 14 of the first bristle 12. At the bottom surface 50 the obstacle slips off the first bristle 12, as the side brush 2 rotates. Accordingly, the obstacle will not entangle with the side brush 2. Also the base ends of all the non-shown bristles of the side brush 8 are positioned within the recess 52.

Embodiments of the robotic cleaner 30 comprising the above discussed recess 52 in the bottom surface 50 may prevent obstacles from entangling with side brushes of different types than discussed above. For instance, also in a robotic cleaner comprising a side brush with bristles extending radially from the brush body, and having the base ends of the bristles arranged within the recess 52, an obstacle may slip off the side brush as the obstacle reaches the bottom surface 50, as the side brush rotates.

Thus, according to a further aspect there is provided a robotic cleaner 30 comprising a housing 32, a drive arrangement 34 being configured to drive the robotic cleaner 30 along a surface 22 to be cleaned, a debris receptacle 36 arranged inside the housing 32, a nozzle inlet 38 in the housing 32 and facing the surface 22 to be cleaned, and a side brush 2. The side brush 2 comprises a brush body 8, to which numerous bristles 10 including a first bristle 12 are attached. At least some of the numerous bristles 10 are configured to abut against the surface 22 to be cleaned. The side brush 2 is rotatable about a substantially vertical rotation axis 4. The housing 32 comprises a bottom surface 50. The bottom surface 50 is provided with a recess 52. The brush body 8 of the side brush 2 is arranged in the recess 52 at a depth such that a base end 14 of the first bristle 12 is positioned within the recess 52 and during use of the robotic cleaner 30 the base end 14 is arranged above the bottom surface 50.

The description above, in particular relating to FIGS. 4*a*, 4*b*, 5, and 6, also applies to this further aspect. Thus, the same description and the same reference numbers apply to this further aspect.

This invention should not be construed as limited to the embodiments set forth herein. A person skilled in the art will realize that different features of the embodiments disclosed herein may be combined to create embodiments other than those described herein, without departing from the scope of the present invention, as defined by the appended claims. Although the invention has been described with reference to example embodiments, many different alterations, modifications and the like will become apparent for those skilled in the art. For instance may the drive arrangement alternatively comprise three wheels or more than four wheels. A robotic vacuum cleaner may rely on suction only to collect dust and debris, i.e. in some embodiments the elongated brush roll may be omitted. Therefore, it is to be understood that the foregoing is illustrative of various example embodiments and that the invention is defined only by the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A side brush for a robotic cleaner, the side brush being rotatable about a rotation axis in a rotational direction and comprising:

a brush body; and numerous bristles, each of the numerous bristles having a base end at the brush body and an opposite distal end;

wherein the numerous bristles are arranged in bunches, each of the bunches being physically spaced from each adjacent bunch and including a subset of the numerous bristles, and each of the bunches having a separate bristle bunch connection point to the brush body, each separate bristle bunch connection point including a respective hole in the brush body for receiving the numerous bristles in each of the bunches, each respective hole separated around the rotation axis from one another by a predetermined space void of bristles;

wherein each of the numerous bristles in each of the bunches extend freely from their respective base ends, which are fixed inside the respective hole in the brush body, to their respective distal ends;

wherein the rotation axis extends centrally through the brush body and an imaginary line extends perpendicularly to the rotation axis;

wherein each of the numerous bristles in each of the bunches is arranged with its base end at a distance from the rotation axis on the imaginary line, and extends in a bristle direction outwardly from the brush body;

wherein seen in a top view, along the rotation axis, the bristle direction extends at a first angle (a) to the imaginary line with the distal end pointing rearwardly in relation to the rotational direction, and the imaginary line intersects the respective base end of each of the numerous bristles in each of the bunches, and wherein seen in a side view, along the imaginary line, the bristle direction extends at a second angle ($\beta$) to the rotation axis pointing away from the brush body, and the rotation axis intersects the respective base end of each of the numerous bristles in each of the bunches.

2. The side brush according to claim 1, wherein the first angle ($\alpha$) is within a range of 30-90 degrees to the imaginary line.

3. The side brush according to claim 1, wherein the second acute angle ($\beta$) is within a range of 1-85 degrees to the rotation axis.

4. The side brush according to claim 1, wherein each of the numerous bristles has a diameter within a range of 0.05-0.3 millimeters.

5. The side brush according to claim 1, wherein each of the numerous bristles has a length within a range of 15-200 millimeters.

6. The side brush according to claim 1, having a mean bristle density of at least 3 bristles/degree with a maximum angle between at least two of the numerous bristles of 30 degrees.

7. The side brush according to claim 1, wherein the numerous bristles are arranged in at least eight bunches of bristles around the brush body.

8. The side brush according to claim 7, each of the at least eight bunches of bristles comprises at least 150 bristles.

9. The side brush according to claim 1, wherein the brush body is substantially circular and has a diameter within a range of 15-70 millimeters.

10. The side brush according to claim 1, wherein each of the numerous bristles has a bristle direction that, when seen in a top view, along the rotation axis, extends at a respective first angle ($\alpha$) to a respective imaginary line with a respective distal end pointing rearwardly in relation to the rotational direction, and, when seen in a side view, along the respective imaginary line, the respective bristle direction extends at a respective second angle ($\beta$) to the rotation axis pointing away from the brush body.

11. The side brush according to claim 1, wherein each of the numerous bristles has a diameter within a range of 0.1-0.2 millimeters.

12. The side brush according to claim 1, wherein each of the numerous bristles has a length within a range of 40-70 millimeters.

13. The side brush according to claim 1, wherein the brush body is substantially circular and has a diameter within a range of 20-50 millimeters.

* * * * *